US009565906B2

(12) United States Patent
Nakamura

(10) Patent No.: US 9,565,906 B2
(45) Date of Patent: Feb. 14, 2017

(54) MULTI-JOINT BENDING STRUCTURE AND WEARABLE DEVICE USING MULTI-JOINT BENDING STRUCTURE

(71) Applicant: FUJITSU LIMITED, Kawasaki-shi Kanagawa (JP)

(72) Inventor: Yutaka Nakamura, Atsugi (JP)

(73) Assignee: FUJITSU LIMITED, Kawasaki (JP)

( * ) Notice: Subject to any disclaimer, the term of this patent is extended or adjusted under 35 U.S.C. 154(b) by 260 days.

(21) Appl. No.: 14/603,655

(22) Filed: Jan. 23, 2015

(65) Prior Publication Data

US 2015/0223574 A1 Aug. 13, 2015

(30) Foreign Application Priority Data

Feb. 7, 2014 (JP) ..... 2014-022537

(51) Int. Cl.
*A44C 5/00* (2006.01)
*A45F 5/00* (2006.01)
*A44C 5/02* (2006.01)

(52) U.S. Cl.
CPC ..... *A44C 5/0053* (2013.01); *A44C 5/022* (2013.01); *A45F 5/00* (2013.01); *A45F 2005/008* (2013.01); *Y10T 403/32016* (2015.01)

(58) Field of Classification Search
CPC ..... A44C 5/0053; A44C 5/022; A45F 5/00; A45F 2005/008; Y10T 403/32016
USPC ..... 224/181, 164
See application file for complete search history.

(56) References Cited

U.S. PATENT DOCUMENTS 4,817,064 A * 3/1989 Milles ..... A44C 17/02 224/164
5,331,610 A * 7/1994 Kikuchi ..... G04B 37/1486 224/164
5,927,577 A * 7/1999 Braun ..... A44C 5/24 224/164

(Continued)

FOREIGN PATENT DOCUMENTS

JP H11-239504 9/1999
JP 2005-34340 A1 2/2005

*Primary Examiner* — Justin Larson
*Assistant Examiner* — Lester L Vanterpool
(74) *Attorney, Agent, or Firm* — Kratz, Quintos & Hanson, LLP

(57) ABSTRACT

A multi-joint bending structure includes: a first-band-piece including joint potions on both ends; bending-units enabling the multi-joint-bending-structure to change in position between a straight state and a bent state; a third-band-piece including a joint potion provided on one end, the joint portion connected to the joint potion of the end of one of the bending-units; one pair of two linear bodies, each of the linear bodies having one end fixed to the housings and another end movable along the housings; and an assisting-force-generation-mechanism provided at predetermined opposed positions of the pair of two linear bodies and configured to generate assisting force, wherein the assisting-force-generation-mechanism includes rod-like bodies, a contracting-elastic-body inserted into the gap, and two piece members which both the ends of the overlapping potions energized by the piece members switch over, and the contracting force of the elastic-body acts as the assisting force between both the ends.

20 Claims, 15 Drawing Sheets

(56) References Cited

U.S. PATENT DOCUMENTS

| | | | | |
|---|---|---|---|---|
| 6,168,309 | B1 * | 1/2001 | Pantet | A44C 5/022 224/164 |
| 6,227,006 | B1 * | 5/2001 | Pantet | A44C 5/022 59/79.1 |
| 6,328,188 | B1 * | 12/2001 | Boznos | A44C 5/107 224/164 |
| 7,682,069 | B2 * | 3/2010 | Hyatt | A44C 5/24 224/164 |
| 8,601,784 | B2 * | 12/2013 | Kaltenrieder | A44C 5/185 24/265 B |
| 2002/0009019 | A1 * | 1/2002 | Gunster | A44C 5/107 368/282 |
| 2006/0124674 | A1 * | 6/2006 | Chan | A44C 5/04 224/164 |
| 2006/0208017 | A1 * | 9/2006 | Hartzband | A44C 5/107 224/164 |
| 2007/0241148 | A1 * | 10/2007 | Strasser | A44C 5/14 224/164 |
| 2008/0159085 | A1 * | 7/2008 | Hozumi | G04B 37/1486 368/282 |
| 2013/0145795 | A1 * | 6/2013 | Asami | A44C 5/0053 63/1.13 |

* cited by examiner

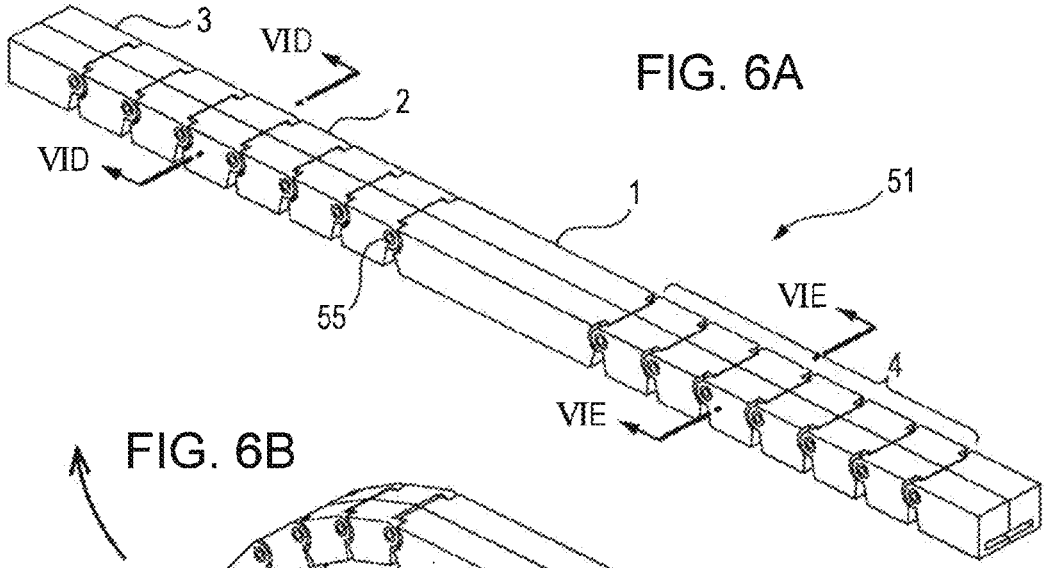
FIG. 6A
FIG. 6B
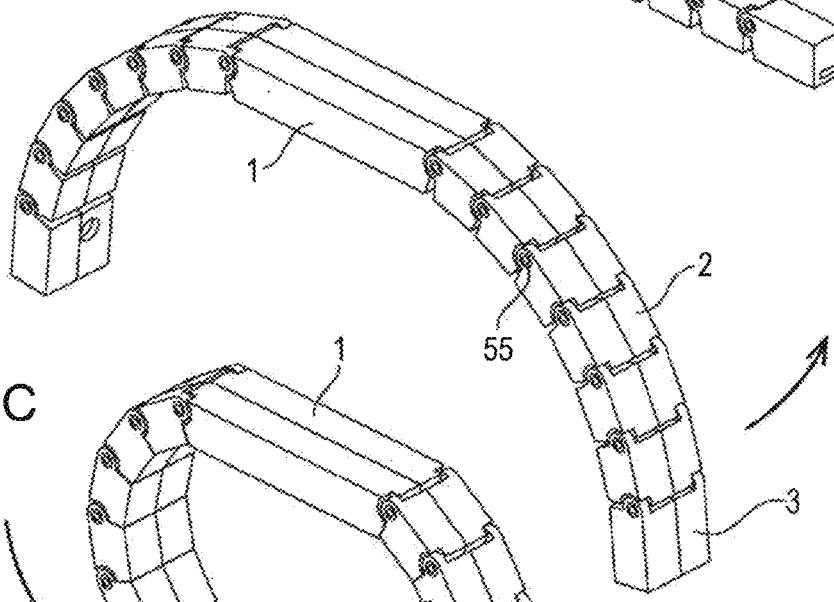
FIG. 6C
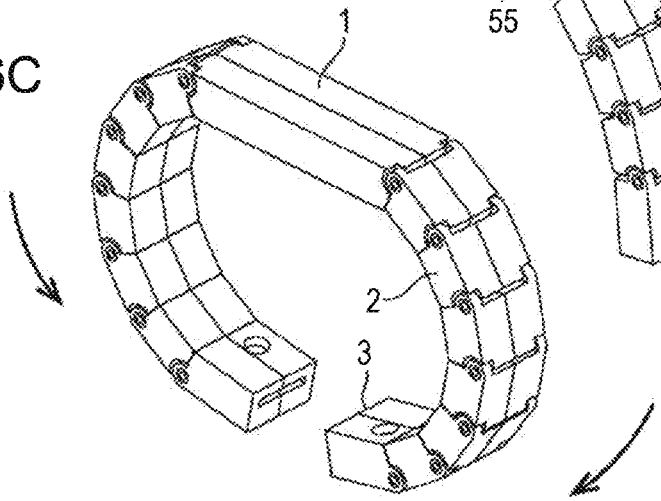
FIG. 6D
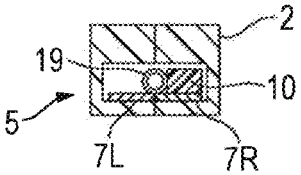
FIG. 6E
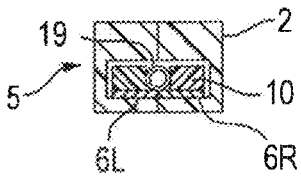

MULTI-JOINT BENDING STRUCTURE AND WEARABLE DEVICE USING MULTI-JOINT BENDING STRUCTURE

CROSS-REFERENCE TO RELATED APPLICATION

This application is based upon and claims the benefit of priority of the prior Japanese Patent Application No. 2014-022537 filed on Feb. 7, 2014, the entire contents of which are incorporated herein by reference.

FIELD

The embodiments discussed herein are related to a multi-joint bending structure and a wearable device using the structure.

BACKGROUND

In recent years, wearable devices have been put into practical use with achievement of downsizing of information terminals such as mobile phones. The wearable device is a small information terminal usable by being attached to a human body by a band (such a wearable device is hereinafter referred to as a wearable terminal). Promising wearable terminals are of types such as a watch type and a wrist band type in which a terminal is attached with a bendable band wound about an arm.

Meanwhile, only few wearable terminals are used by being continuously attached to the human bodies in spite of their names "wearable". Normal wearable terminals are often used in both states attached to or detached from the human body.

Then, as a band usable in a wearable terminal to attach or detach the wearable terminal, there are a band having a structure disclosed in Japanese Laid-open Patent Publication No. 2005-034340 and a band disclosed in Japanese Laid-open Patent Publication No. 11-239504. Japanese Laid-open Patent Publication No. 2005-034340 discloses a band with magnet in which hard band pieces are joined to make the band elastic and magnets are arranged not to project from the band.

On the other hand, Japanese Laid-open Patent Publication No. 11-239504 discloses a decorative bracelet in which multiple links (pieces) are joined by columnar bars one after another like joints and the links and the columnar bars are held together by flexible connecting materials.

However, when a wearable terminal is attached or detached, similar to a watch belt, a belt has to be hooked or unhooked every time. Thus, there is a problem that an attaching/detaching operation is troublesome. There is also another problem that a belt made of resin or a bending-type wrist band tends to keep a bent form even when detached, and is bothersome since the belt or the wrist band bends even after being detached. Similarly, the band disclosed in Japanese Laid-open Patent Publication No. 2005-034340 has problems that since the band has spring force only in a direction in which the band shrinks, the band may not be easily detached, and is bothersome as the band remains bent even after being removed.

In one aspect, the present application has an object of providing a multi-joint bending structure that may be attached to or detached from a human body with a single touch, and a wearable device (wearable terminal) using the structure.

SUMMARY

According to an aspect of the invention, a multi-joint bending structure includes: a first-band-piece including joint potions on both ends; bending-units enabling the multi-joint-bending-structure to change in position between a straight state and a bent state; a third-band-piece including a joint potion provided on one end, the joint portion connected to the joint potion of the end of one of the bending-units; one pair of two linear bodies, each of the linear bodies having one end fixed to the housings and another end movable along the housings; and an assisting-force-generation-mechanism provided at predetermined opposed positions of the pair of two linear bodies and configured to generate assisting force, wherein the assisting-force-generation-mechanism includes rod-like bodies, a contracting-elastic-body inserted into the gap, and two piece members which both the ends of the overlapping potions energized by the piece members switch over, and the contracting force of the elastic-body acts as the assisting force between both the ends.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 6A is a perspective view when the multi-joint bending structure of the first example of the first mode of the present application is in the I-like form, FIG. 6B is a perspective view illustrating a state while the multi-joint bending structure illustrated in FIG. 6A is changing in position to the C-like form, FIG. 6C is a perspective view illustrating a state in which the multi-joint bending structure illustrated in FIG. 6B changes in position to the C-like form, FIG. 6D is a sectional view of a member of the multi-joint bending structure illustrated in FIG. 6A, indicated by a line VID of cutting plane, and FIG. 6E is a sectional view of a member of the multi-joint bending structure illustrated in FIG. 6A, the member being indicated by a line VIE of cutting plane;

FIG. 7B is in the I-like form and FIG. 8B is an exploded perspective view illustrating a state of the bending rod-like body when the multi-joint bending structure illustrated in FIG. 7E and FIG. 7F is in the C-like form;

FIG. 11C is in the Hike form.

DESCRIPTION OF EMBODIMENTS

Hereinafter, embodiments of the present application are described in detail based on specific examples. In the examples described below, an example in which an assisting force generation mechanism is embedded in a bending unit of a multi-joint bending structure is described as an example of a first mode, and an example in which an assisting force generation mechanism is embedded in a first band piece part of a multi-joint bending structure is described as an example of a second mode.

Figure 1A:
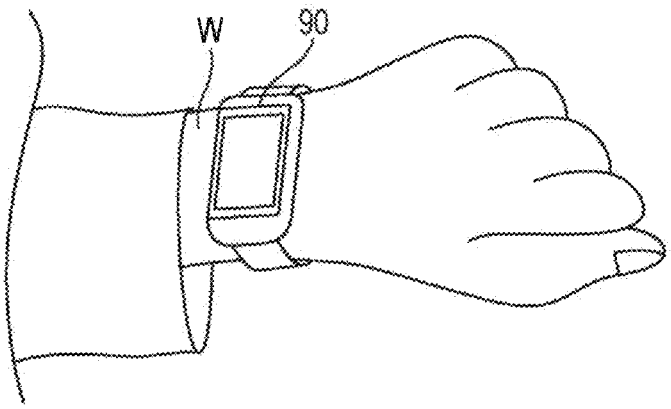
FIG. 1A is a perspective view illustrating a state in which a user wears a watch-type wearable terminal.
Figure 1B:
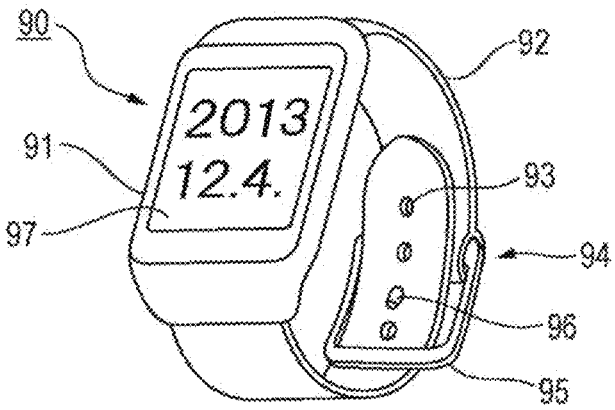
FIG. 1B is a perspective view illustrating a mechanism for attachment to an arm of the wearable terminal illustrated in FIG. 1A.

Before examples of the present application are described, first, a wearable device to be attached to the human body and used is described. FIG. 1A illustrates a state in which a user wears a watch-type wearable device 90 on an arm W. In the wearable device 90 illustrated in FIG. 1A, a belt unit 92 is provided on a main body 91 including a display unit 97, as illustrated in FIG. 1B. The wearable device 90 is designed to be wound around the arm W and fixed by a buckle 94. The buckle 94 has a frame 95 and a pin 96. When the wearable device 90 is attached to the arm W, the belt unit 92 is inserted through the frame 95 and then the pin 96 is inserted into a hole 93 provided at an end of the belt unit 92.

Figure 1C:
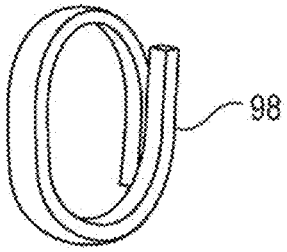
FIG. 1C is a perspective view of a bendable wrist band.

Thus, the watch-type wearable device 90 has to be fastened or removed every time the belt unit 92 is attached to or removed from the arm W, and an attaching/detaching operation is troublesome. In addition, FIG. 1C illustrates a bendable wrist band 98 which is generally made of resin. Since the wrist band tends to bend when removed, the wrist band in a removed state is bulky and bothersome. Hence, the present application provides a wearable device that may be attached to or detached from the human body with a single touch and that is not bulky even when the wearable device is in a removed state.

Figure 2A:
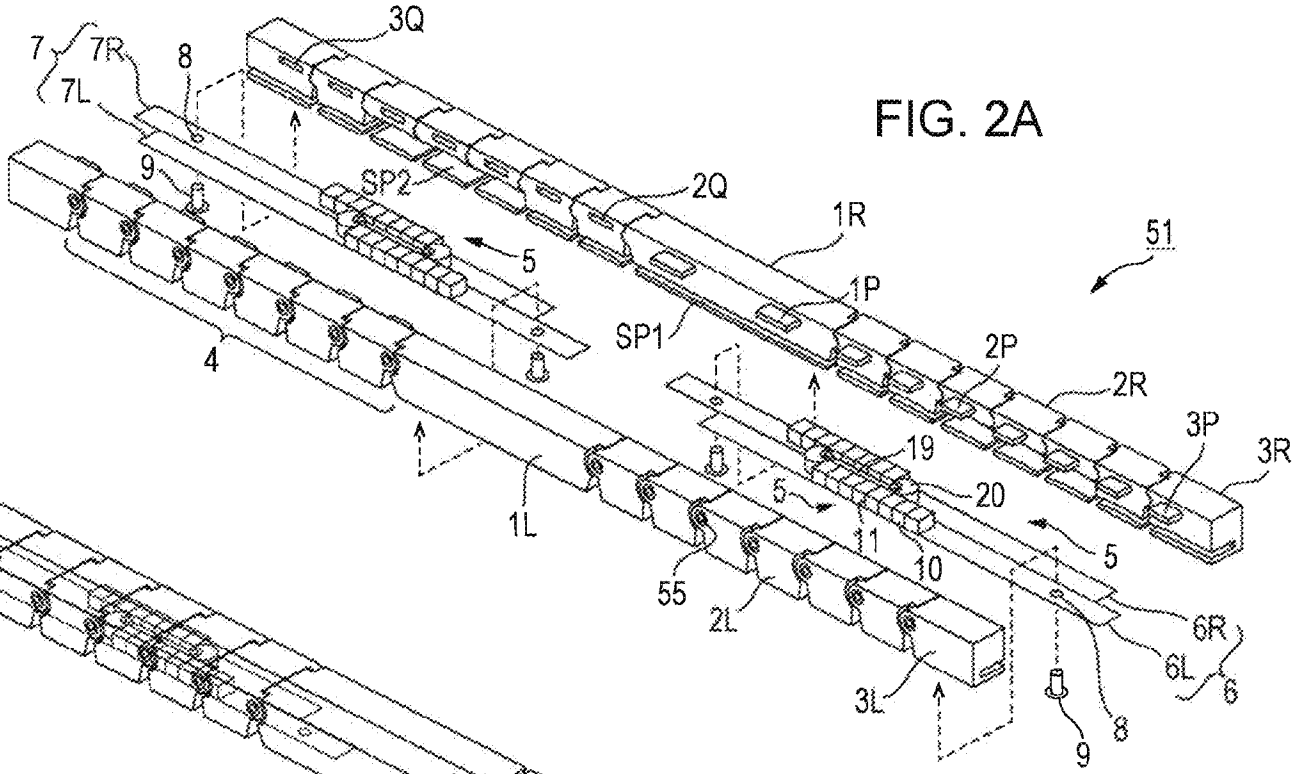
FIG. 2A is an assembly perspective view illustrating the structure of the multi-joint bending structure of a first example of a first mode of the present application and FIG. 2B is a partial perspective view of the structure after assembly of the multi-joint bending structure illustrated in FIG. 2A.
Figure 2B:
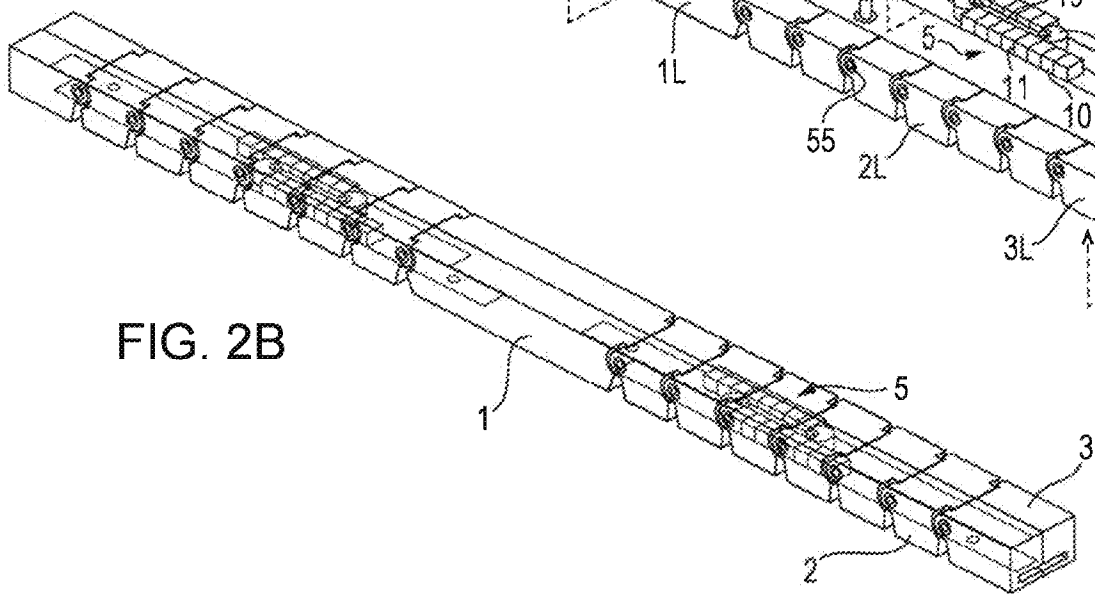

FIG. 2A illustrates a structure of a multi-joint bending structure 51 of the first example of the first mode of the present application in or to which a wearable device may be incorporated or attached. In addition, FIG. 2B is a partial perspective illustration of appearance after assembly of the multi-joint bending structure 51 illustrated in FIG. 1A. The multi-joint bending structure 51 includes a first band piece 1, multiple second band pieces 2 arranged to each of the right and left of the first band piece 1 and forming bending units 4, and third band pieces 3 connected to tips of the bending units 4 located to the right and left of the first band piece 1. The first band piece 1 includes joint potions 55 on the right and left sides. Then, six second band pieces 2 each including the joint potions 55 on both (right and left) ends are connected to each of the right and left joint potions 55 to form the bending unit 4. Then, the third band pieces 3 are connected to the outermost second band pieces 2 by the joint potions 55.

When viewed from the lateral side, the first band piece 1 and the second band piece 2 have a trapezoid shape and include parallel long side and short side, as well as two oblique sides. Then, the joint potion 55 connects the long sides of the first band piece 1 and the second band piece 2. As a result, the first band piece 1 and the second band piece 2 may bend in a direction which makes the adjacent oblique sides move closer, that is to say, toward the short side. Note that a shape when the third band piece 3 is viewed from the lateral face may be the same as the second band piece 2, the side on the free end side is orthogonal to the long side and the short side since the third band pieces 3 are positioned at both ends of the multi-joint bending structure 51.

In housings of the connected first to third band pieces 1 to 3, a space area SP1 where to house belts 6, 7 and space areas SP2 where to house assisting force generation mechanisms 5 fixed onto the belts 6, 7 are provided on an inner side which becomes an inner peripheral side when the structure is bent. Then, in order to house the belts 6, 7 and the assisting force generation mechanism 5 in the space areas SP1, SP2, the connected first to third band pieces 1 to 3 are dividable into two, i.e., to the right and left. FIG. 2A illustrates the connected first to third band pieces 1L, 2L, 3L on the left side and the first to third band pieces 1R, 2R, 3R on the right side. Engagement projections 1P, 2P, 3P on one opposed face of each band piece being fitted into engagement concaves 1Q, 2Q, 3Q (1Q is not illustrated) on the other opposed face, the first band pieces 1L, 2L, 3L on the left side and the first to third band pieces 1R, 2R, 3R on the right side are connected.

In the multi-joint bending structure 51, a pair of two parallel belts 6L, 6R are provided on one side of the first band piece 1, while a pair of two parallel belts 7L, 7R are provided on the other side. At one end of the belt 6L and one end of the belt 7R are provided a hole 8 into which a screw 9 is inserted, thus the one end of the belt 6L and the one end of the belt 7R being screwed to the housing of the third band piece 3. The other ends of the belt 6L and the belt 7R are positioned in the first band piece 1 when the bending unit 4 is in a straight state. A hole 8 is also provided at one end of the belt 6R and at one end of the belt 7L. The screw 9 is also inserted into the hole 8, thus the one end of the belt 6R and the one end of the belt 7L being screwed to the housing of the first band piece 1. Other ends of the belt 6R and the belt 7L are positioned in the third band piece 3 when the bending unit 4 is in a straight state. When the bending unit 4 bends, the other ends of the belt 6L and the belt 7R enter the interior of the first band piece 1, while the other ends of the belt 6R and the belt 7L enter the interior of the third band piece 3.

An assisting force generation mechanism 5 provided on each of the pair of belts 6L, 6R and the pair of belts 7L, 7R includes two bending rod-like bodies 10 and piece members 20 respectively connected to an extension spring 19 and both ends of extension spring 19. The extension spring 19 is inserted into a gap between opposed faces of the bending rod-like body 10. The two bending rod-like bodies 10 are fixed onto the belts 6L, 6R and the belts 7L, 7R, respectively, and to any part where the bending rod-like bodies 10 are not fixed, slits 11 reaching the belts 6L, 6R and the belts 7L, 7R are provided at predetermined intervals. The two bending rod-like bodies 10 have overlapping portions between which the extension spring 19 is inserted and non-overlapping portions located outside of the overlapping portions. A diameter of the piece member 20 is larger than width of the gap lying between the opposed faces of the bending rod-like bodies 10. Pulled by the extension spring 19, the piece member 20 is held on end faces of the bending rod-like bodies 10 located on both sides of the overlapping portions.

When the bending unit 4 is in a straight state, the multi-joint bending structure 51 is also in a straight state. In a state in which no external force is applied to the multi-joint bending structure 51, energizing force of the extension spring 19 keeps the multi-joint bending structure 51 in the straight state. Note that since a bent state of the multi-joint bending structure 51 may be hereinafter referred to as a C-like state, the straight state of the multi-joint bending structure 51 may be referred to as an I-like state. Furthermore, a state in which only one bending unit 4 of the multi-joint bending structure 51 is bent may be referred to as a J-like state.

Figure 3A:
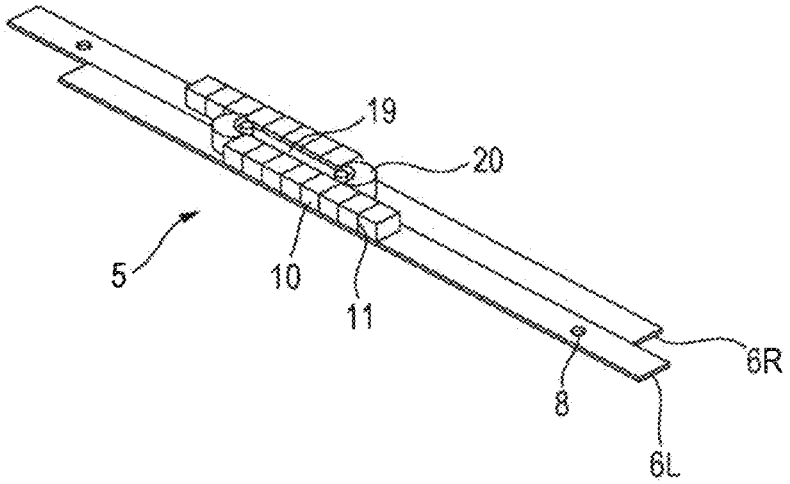
FIG. 3A is a perspective view illustrating connection with a belt of an assisting force generation mechanism used in the multi-joint bending structure of the present application.
Figure 3B:
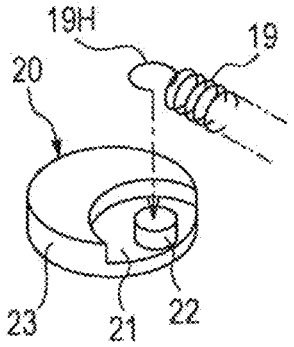
FIG. 3B is an assembly perspective view illustrating an example of connection with a piece member of an extension spring used in the assisting force generation mechanism illustrated in FIG. 3A.
Figure 3C:
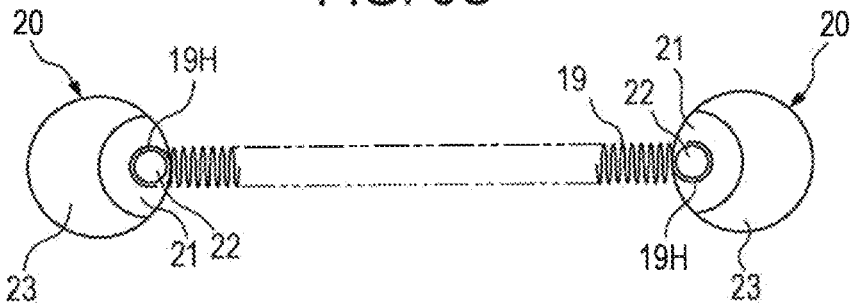
FIG. 3C is a plan view illustrating a connection state of the extension spring used in the assisting force generation mechanism illustrated in FIG. 3A with the piece member.

Here, structure and operation of the assisting force generation mechanism 5 used in the multi-joint bending structure 51 of the present application are described with reference to FIG. 3A to FIG. 5E. FIG. 3A illustrates the assisting force generation mechanism 5 which is taken from FIG. 2A together with the belts 6L, 6R. The assisting force generation mechanism 5 includes bending rod-like bodies 10 which are respectively fixed to the adjacent parallel belts 6L, 6R, the extension spring 19, and the piece members 20. As illustrated in FIG. 3B, in the piece member 20, a part of a disk-like main body 23 is cut out like an arc to form a notch area 21, and a post 22 is installed in a protruding manner in the notch area 21 close to the outer periphery of the main body 23. Hook units 19H of the extension springs 19 are fixed to the post 22. FIG. 3C illustrates a state in which both ends of the extension spring 19 are bridged to the posts 22 of the piece members 20 by means of the hook units 19H. Since the hook units 19H of the extension springs 19 are rotatable to the posts 22 of the piece members 20, the piece members 20 may oscillate with respect to the extension springs 19. A shape of the piece members 20 is not limited to the shape in this example.

The two bending rod-like bodies 10 have overlapping portions between which the extension spring 19 is inserted and non-overlapping portions located outside of the overlapping portions. The piece members 20 are latched to end faces of the bending rod-like bodies 10 located at both ends of the overlapping portions. In the state illustrated in FIG. 3A, the extension spring 19 causes energizing force to act on a direction which makes the two piece members 20 move closer. In addition, since the belts 6L, 6R bend making convex the side where the assisting force generation mechanism 5 is provided, slits 11 are provided on the bending rod-like bodies 10 respectively fixed onto the belts 6L, 6R so that the bending rod-like bodies 10 may follow bending of the belts 6L, 6R. The slits 11 are provided at predetermined intervals from a face opposite to the belts 6L, 6R of the bending rod-like bodies 10 so as to reach the belts 6L, 6R.

Then, when the bending unit 4 bends, the belts 6L, 6R also bend and the two bending rod-like bodies 10 move to a direction in which the extension spring 19 is stretched. Here, with reference to FIG. 4A to FIG. 4C, the way how a tip of the belt 6L moves and length for which the tip protrudes from the first band piece 1 changes when the bending unit 4 formed by the six second band pieces 2 bends is described. As described above, in the state in which the long sides of the first to third band pieces 1 to 3 are connected by the joint potions 55, as illustrated in FIG, 4A, gaps Si to S7 exist between adjacent short sides of the first to third band pieces 1 to 3. Then, it is supposed that one end of the belt 6L is fixed by the screw 9 in the third band piece 3 and a free end 6E protrudes from a joint potion 55R of the first band piece 1 for length L.

Figure 4A:
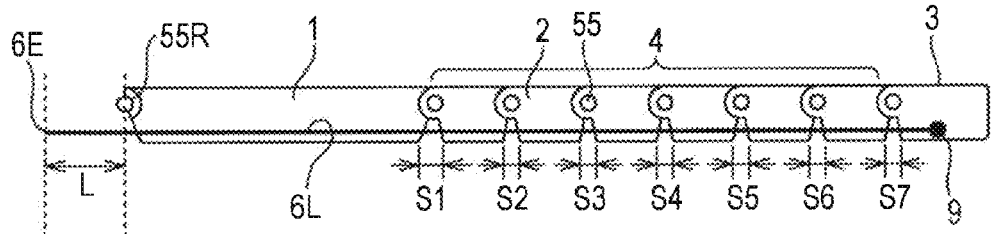
FIG. 4A to FIG. 4C are explanatory diagrams illustrating in a phased manner how a belt arranged on an inner periphery side of a bending unit of a multi-joint bending structure changes when the multi-joint bending structure changes in position from an I-like form to a C-like form.
Figure 4B:
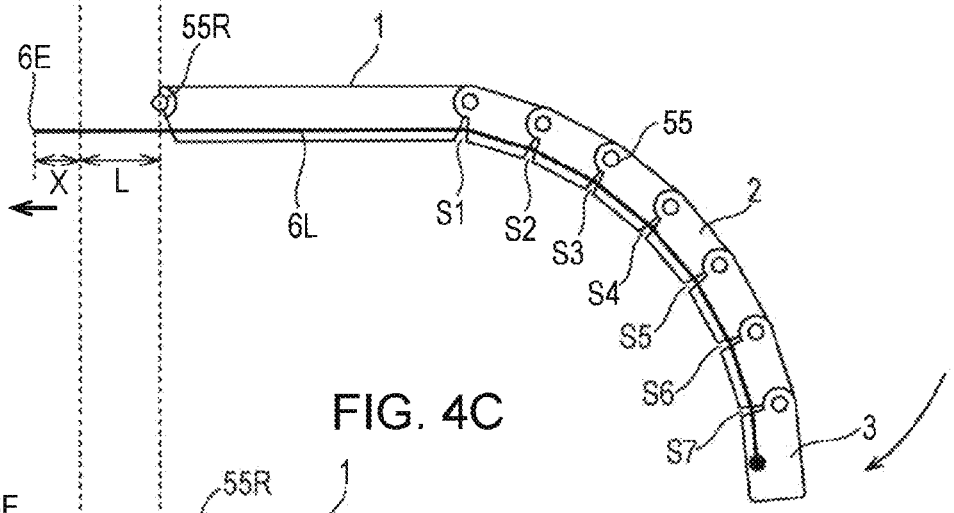

It is supposed that the bending unit 4 bends to the direction in which adjacent oblique sides of the first to third band pieces 1 to 3 move close and the multi-joint bending structure 51 illustrated in FIG. 4A shifts from the I-like form to a state illustrated in FIG. 4B. In this state, width of the gaps Si to S7 of the adjacent short sides of the first to third band pieces 1 to 3 is narrow. Then, since one end of the belt 6L is fixed by the screw 9 in the third band piece 3, the free end 6E of the belt 6L moves for the length for which the width of the gaps S1 to 57 is narrowed. If the length for which the width of the gaps S1 to S7 is narrowed is X, the free end 6E of the belt 6L protrudes from the joint potion 55R of the first band piece 1 only for length (L+X).

Figure 4C:
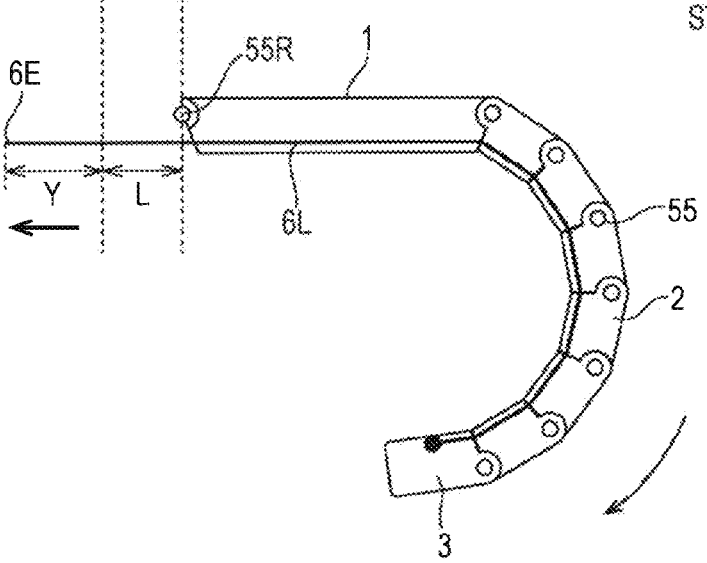

When the multi-joint bending structure 51 illustrated in FIG. 4B changes from the I-like form to the C-like form illustrated in FIG. 4C, the gaps S1 to S7 of the adjacent short sides of the first to third band pieces 1 to 3 disappear. Here, if the total length of the gaps S1 to S7 of the adjacent short sides of the first to third band pieces 1 to 3 is Y, the free end 6E of the belt 6L protrudes from the joint potion 55 of the first band piece 1 only for the length of (L+Y). Then, the free end 6E of the belt 6L moves only for the length of Y, which means that the bending rod-like bodies 10 fixed onto the belt 6L also move only for the length of Y.

In FIG. 4A to FIG. 4C, movement of the tip 6E of the belt 6L when the bending unit 4 bends from the I-like form to the C-like form is described. Then, the tip of the belt 6R which is paired with the belt 6L similarly moves to a direction opposite to the traveling direction of the tip 6E of the belt 6L. Specifically, since one end of the belt 6R is fixed by the screw 9 in the first band piece 1, the tip of the belt 6R located in the third band piece 3 moves only for the length of Y in the third band piece 3 when the bending unit 4 bends from the I-like form to the C-like form. Then, as the belt 6R moves, the bending rod-like bodies 10 fixed onto the belt 6R also move only for the length of Y.

Then, operation of the assisting force generation section 5 when the bending rod-like bodies 10 fixed on the two belts 6L, 6R move in the opposite directions is described with reference to FIG. 5A to FIG. 5E. However, for clarity of description, operation of the assisting force generation mechanism 5 in a state in which the two belts 6L, 6R and the bending rod-like bodies 10 move without bending is described.

Figure 5A:
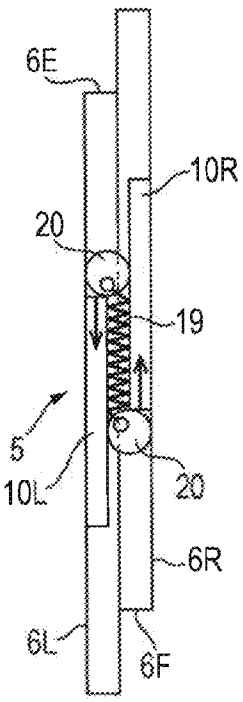
FIG. 5A to FIG. 5E are explanatory diagrams illustrating operation of the assisting force generation mechanism illustrated in FIG. 3A.

FIG. 5A illustrates a state of belts 6L, 6R, two bending rod-like bodies 10 including overlapping portions and non-overlapping portions, an extension spring 19, and piece members 20 when a bending unit 4 does not bend. Here, it is supposed that the bending rod-like body 10 fixed to the belt 6L is the bending rod-like body 10L, the bending rod-like body 10 fixed to the belt 6R is the bending rod-like body 10R, a tip of the belt 6L is 6E, and a tip of the belt 6R is 6F. One of the piece members 20 attached to both ends of the extension spring 19 is latched to an end of the bending rod-like body 10L on the overlapping portion side, while the other is latched to an end of the bending rod-like body 1OR on the overlapping portion side. In this state, pulled by the extension spring 19, the piece members 20 provide the ends where the piece members 20 are latched with energizing force depicted by the arrow. Therefore, the bending rod-like body 10L and the bending rod-like body 1OR maintain the state illustrated in FIG. 5A unless external force acts.

Figure 5B:
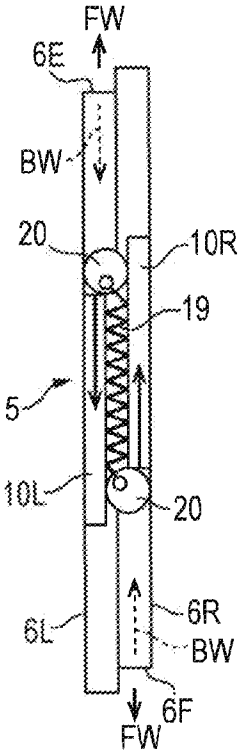

FIG. 5B illustrates a state in which the bending unit 4 is bent from the state illustrated in FIG. 5A, the tip 6E of the belt 6L and a tip 6F of the belt 6R move to a direction indicated by an arrow FW, and the overlapping portions of the bending rod-like body 10L and the bending rod-like body 1OR increase. In this state, the extension spring 19 is extended and length between the piece members 20 fixed to both ends of the extension spring 19 is large. Then, the piece members 20 provide the latched ends with large energizing force indicated by an arrow.

Figure 5C:
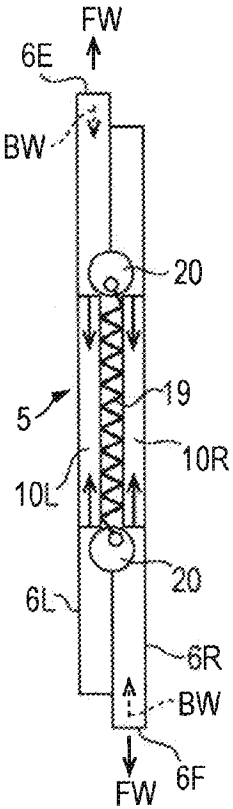

FIG. 5C illustrates a state in which the bending unit 4 is further bent from the state illustrated in FIG. 5B, the tip 6E of the belt 6L and the tip 6F of the belt 6R further move to the direction indicated by the arrow FW, and the bending rod-like body 10L and the bending rod-like body 1OR perfectly overlap. In this state, the extension spring 19 is also extended to the maximum and the length between the piece members 20 fixed to both ends of the extension spring 19 is largest. Then, since the bending rod-like body 10L and the bending rod-like body 10R are in a perfectly overlapped state, the piece members 20 are latched to the ends of both bending rod-like body 1OL and bending rod-like body 10R and provide both ends with the energizing force indicated by the arrow.

Figure 5D:
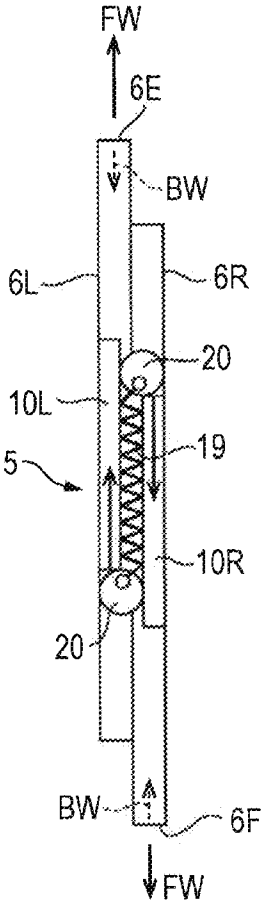

When the bending unit 4 is further bent from the state illustrated in FIG. 5C, and the tip 6E of the belt 6L and the tip 6F of the belt 6R further move to the direction indicated by an arrow FW, latching ends which latch the piece members 20 switch over Specifically, the piece member 20 latched to one end of the bending rod-like body 1OL becomes latched to the end of the bending rod-like body 10R, and the piece member 20 latched to one end of the bending rod-like body 10R becomes latched to the end of the bending rod-like body 10L. Then, as illustrated in FIG. 5D, the direction of the large energizing force provided by the piece member 20 to the latching end of the bending rod-like body 10L matches the traveling direction of the belt 6L indicated by the arrow FW. Similarly, the direction of the large energizing force provided by the piece member 20 to the latching end of the bending rod-like body 10R also matches the traveling direction of the belt 6R indicated by the arrow FW.

Figure 5E:
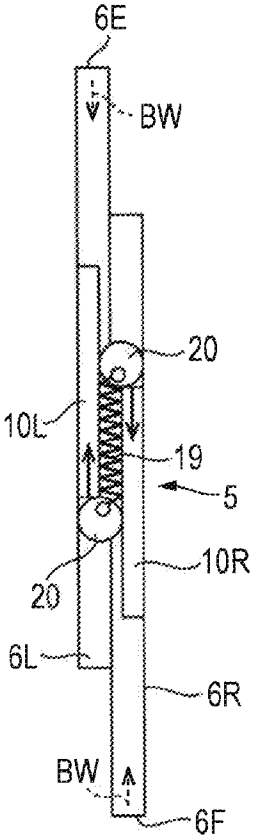

As a result, assisted by the energizing force provided to the ends of the bending rod-like bodies 10L, 10R to which the piece members 20 are latched, the belts 6L and 6R quickly change from the state illustrated in FIG. 5D to a state illustrated in FIG. 5E. The energizing force then may be referred to as assisting force. The state illustrated in FIG. 5E is the same as the state illustrated in FIG. 4C in which the bending unit 4 is bent completely, and the bending unit 4 does not bend any more. In addition, in the state illustrated in FIG. 5E, pulled by the extension spring 19, the piece member 20 provides the latching ends with the energizing force indicated by the arrow. Therefore, unless the external force acts, the bending rod-like body 10L and the bending rod-like body 10R maintain the state illustrated in FIG. 5E.

When the completely bent bending unit 4 is returned to the straight state, the tip 6E of the belt 6L and the tip 6F of the belt 6R move to a direction indicated by a dashed arrow BW in FIG. 5E, and the overlapping portions of the bending rod-like body 10L and the bending rod-like body 1OR increase. In this state, the extension spring 19 is extended and the length between the piece members 20 fixed to both ends of the extension spring 19 is large. Then, the piece members 20 provide the latching ends with large energizing force indicated by the arrow.

FIG. 5C illustrates a state in which the bending unit 4 is further returned to the straight side from the state illustrated in FIG. 5D, the tip 6E of the belt 6L and the tip 6F of the belt 6R further move to the direction indicated by the dashed arrow BW, and the bending rod-like body 10L and the bending rod-like body 10R perfectly overlap. In this state, the extension spring 19 is also extended to the maximum and the length between the piece members 20 fixed to both ends of the extension spring 19 is largest. Then, since the bending rod-like body 10L and the bending rod-like body 10R are in a perfectly overlapped state, the piece members 20 are latched to the ends of both bending rod-like body 10L and bending rod-like body 10R to provide both ends with the energizing force indicated by the arrow.

When the bending unit 4 is further returned to the straight side from the state illustrated in FIG. 5C, and the tip 6E of the belt 6L and the tip 6F of the belt 6R further move to the direction indicated by the arrow BW, the latching ends which latch the piece members 20 switch over Specifically, the piece member 20 latched to one end of the bending rod-like body 10R becomes latched to the end of the bending rod-like body 10L, and the piece member 20 latched to one end of the bending rod-like body 10L becomes latched to the end of the bending rod-like body 10R. Then, as illustrated in FIG. 5B, the direction of the large energizing force provided by the piece member 20 to the latching end of the bending rod-like body 10L matches the traveling direction of the belt 6L indicated by the dashed arrow BW. Similarly, the direction of the large energizing force provided by the piece member 20 to the latching end of the bending rod-like body 10R also matches the traveling direction of the belt 6R indicated by the dashed arrow BW.

As a result, assisted by the energizing force provided to the ends of the bending rod-like bodies 10L, 10R to which the piece members 20 are latched, the belts 6L and 6R quickly change from the state illustrated in FIG. 5B to the state illustrated in FIG. 5A. The state illustrated in FIG. 5A is the same as the state illustrated in FIG. 4A in which the bending unit 4 is completely straight, and the bending unit 4 is straight and no longer changes. As described above, the state illustrated in FIG. SA is a state in which the piece members 20 provide the ends pulled by the extension spring 19 and latched with the energizing force indicated by the arrow, and the bending rod-like body 10L and the bending rod-like body 10R maintain the state illustrated in FIG. 5A unless the external force acts.

As described above, according to the assisting force generation mechanisms 5 provided on the belt 6L and the belt 6R, when the bending unit 4 changes in position from the straight state to the bent state, a bending operation may be performed smoothly since the assisting force generation mechanisms 5 cause the assisting force to act in the course in which the bending unit 4 is bending. In contrast, when the bending unit 4 changes in position from the bent state to the straight state, an operation to straighten the bending unit 4 may be performed smoothly since the assisting force by the assisting force generation mechanisms 5 acts in the course of the operation to straighten the bending unit 4.

FIG. 6A illustrates a state in which a multi-joint bending structure 51 of the first example of the first mode of the present application is in an I-like form. FIG. 6B illustrates a state while the multi-joint bending structure 51 illustrated in FIG. 6A changes in position to a C-like form. In addition, FIG. 6D is a sectional view of a member indicted by a line VID of cutting plane of the multi-joint bending structure 51 illustrated in FIG, 6A. FIG. 6E is a sectional view of a member indicated by a line VIE of cutting plane of the multi-joint bending structure 51 illustrated in FIG. 6A, illustrating an internal assisting force generation mechanism 5. When the multi-joint bending structure 51 changes in position from the state illustrated in FIG. 6A to the state illustrated in FIG. 6B, the external force is applied to the bending unit 4 of the multi-joint bending structure 51 to bend the bending unit 4. On the one hand, after the multi-joint bending structure 51 changes in position to the state illustrated in FIG. 6B, and if slight external force is applied to the bending unit 4 in this state, the multi-joint bending structure 51 quickly changes in position from the state illustrated in FIG. 6B to the state illustrated in FIG. 6C due to operation of the embedded assisting force generation mechanism 5.

Figure 7A:
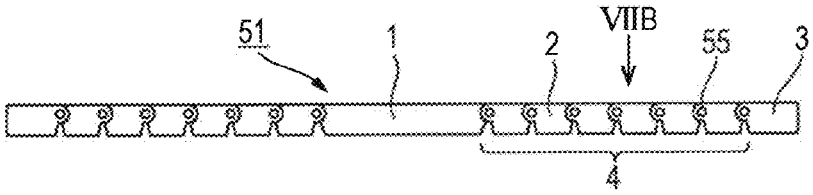
FIG. 7A is a side elevation when the multi-joint bending structure of the first example of the first mode of the present application is in the I-like form.
Figure 7B:
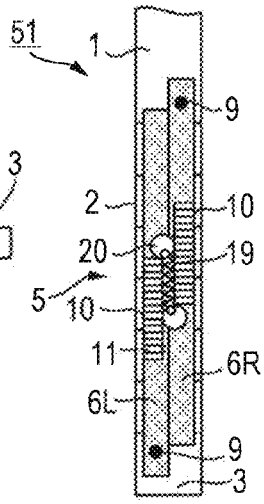
FIG. 7B is an arrow view, when viewed from a direction of an arrow VIIB, of a state of the assisting force generation mechanism which is in the multi-joint bending structure illustrated in FIG. 7A.
Figure 8A:
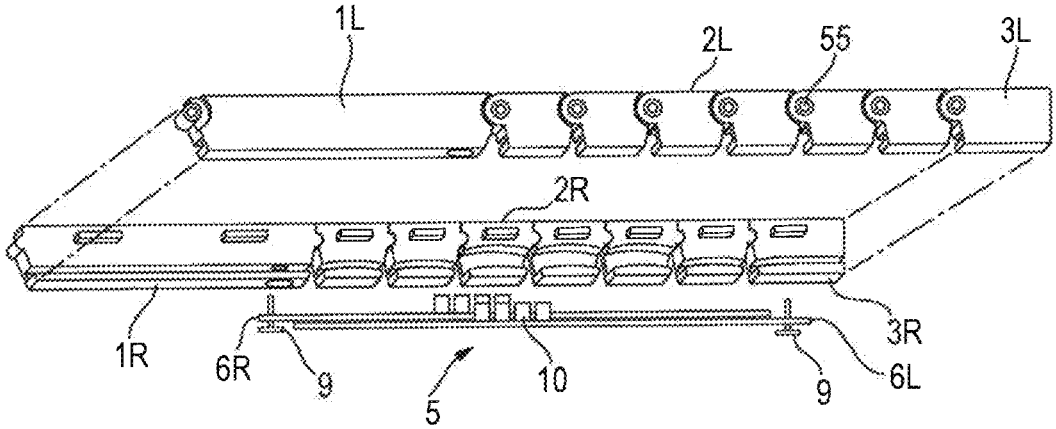
FIG. 8A is an exploded perspective view illustrating a state of a bending rod-like body when the multi-joint bending structure illustrated in FIG. 7A

FIG. 7A is a view from the lateral face of a state in which the multi-joint bending structure 51 of the first example of the first mode of the present application is in an I-like form. In addition, FIG. 7B is a view from a direction of an arrow VIIB of a state of the assisting force generation mechanism 5 fixed to belts 6L, 6R which are located within the multi-joint bending structure 51 illustrated in FIG. 7A. When the multi-joint bending structure 51 is in the I-like form, bending rod-like body 10 of the assisting force generation mechanism 5 is also straight, as illustrated in FIG. 8A. Note that since the assisting force generation mechanism 5 illustrated in FIG. 8A illustrates a state of the bending rod-like body 10, depiction of an extension spring 19 and piece members 20 is omitted in this figure. In addition, since the assisting force generation mechanisms 5 fixed to belts 7L, 7R which are located within the multi-joint bending structure 51 operate similarly to the assisting force generation mechanisms 5 fixed to the belts 6L, 6R, depiction and description thereof are omitted. The multi-joint bending structure 51 in the I-like form maintains the I-like form due to the action of the assisting force generation mechanism 5 as described above.

Figure 7C:
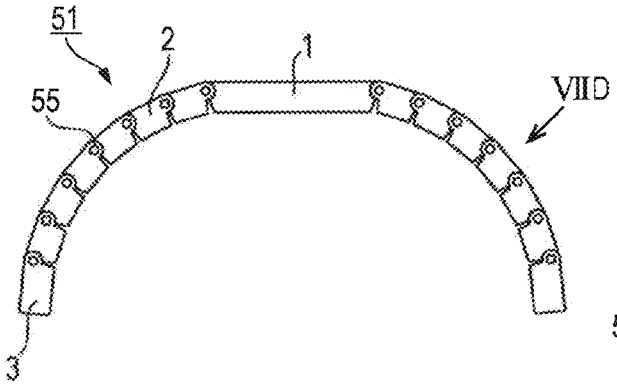
FIG. 7C is a side elevation illustrating a state in which the multi-joint bending structure illustrated in FIG. 7A is changing in position from the I-like form to the C-like form.
Figure 7D:
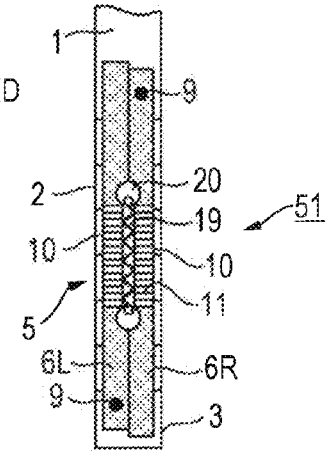
FIG. 7D is an arrow view, when viewed from a direction of an arrow VIID, of a state of the assisting force generation mechanism which is in the multi-joint bending structure illustrated in FIG. 7C.

FIG. 7B is a view from the lateral face of a state of the multi-joint bending structure 51 changing in position from the I-like form to the C-like form as the external force is applied to the bending unit 4 of the multi-joint bending structure 51 illustrated in FIG. 7A. In addition, FIG. 7D is a view from a direction of an arrow VIID of a state of the assisting force generation mechanism 5 which is located within the multi-joint bending structure 51 illustrated in FIG. 7C, illustrating a state in which two bending rod-like bodies 10 of the assisting force generation mechanism 5 perfectly overlap. When the multi-joint bending structure 51 changes in position from the I-like form to the C-like form, the external force is applied from the side of an joint potion 55 to the bending unit 4 of the multi-joint bending structure 51 up to this point in time.

On the one hand, in the state illustrated in FIG. 7C and FIG. 7D, when slight external force is further applied, as described above, the piece member 20 of the assisting force generation mechanism 5 moves and is latched to an end of the bending rod-like body 10 adjacent to the bending rod-like body 10 to which the piece member 20 has been latched till now. Then, a direction in which two piece members 20 of the assisting force generation mechanism 5 energize the bending rod-like bodies 10 matches a travelling direction of the belts 6L, 6R to which the bending rod-like bodies 10 are fixed, and the belts 6L, 6R move due to the energizing force provided by the piece members 20 to the bending rod-like bodies 10, even if no external force is applied.

Figure 7E:
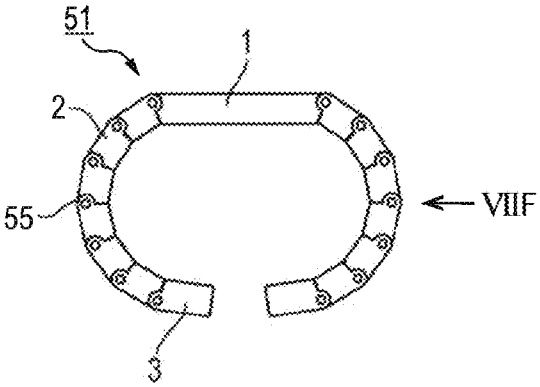
FIG. 7E is a side elevation when the multi-joint bending structure of the first example of the first embodiment of the present application is in the C-like form.
Figure 7F:
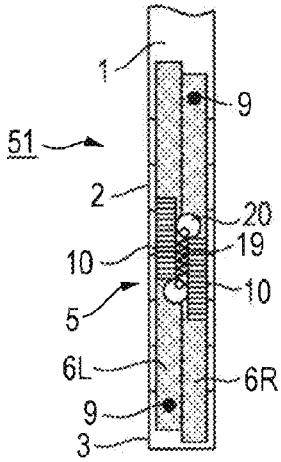
FIG. 7F is an arrow view, when viewed from a direction of an arrow VIIF, of a state of the assisting force generation mechanism which is in the multi-joint bending structure illustrated in FIG. 7E.
Figure 8B:
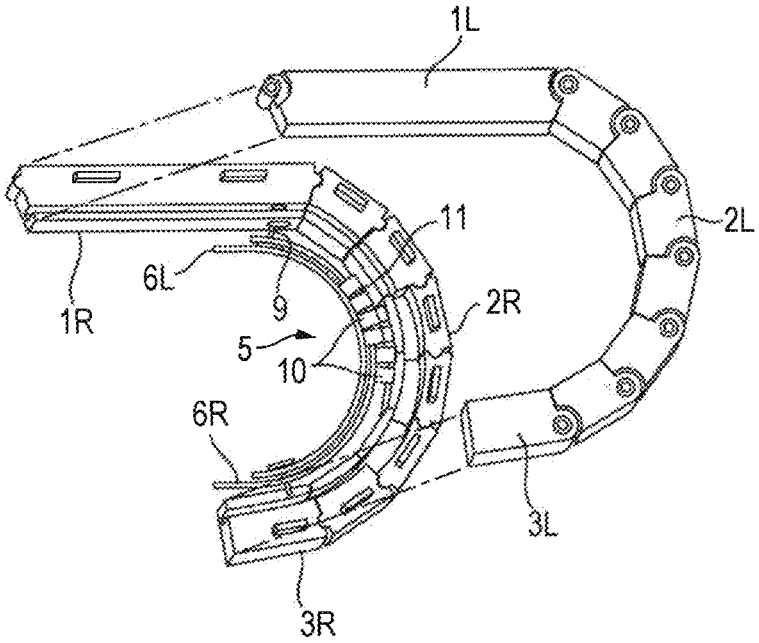

As a result, the multi-joint bending structure 51 quickly changes from a bent state illustrated in FIG. 7C to the C-like form illustrated in FIG. 7E. FIG. 7F is a view from a direction of an arrow VHF of a state of the assisting force generation mechanism S which is within the multi-joint bending structure 51 illustrated in FIG. 7E. FIG. 8B illustrates a state of the assisting force generation mechanism 5 when the multi-joint bending structure 51 illustrated in FIG. 7F is in the C-like form. The bending rod-like bodies 10 accommodate bending of the belts 6L, 6R as parts of slits 11 are spaced and open like a fan. Note that since the assisting force generation mechanism 5 in FIG. 8B illustrates a state of the bending rod-like bodies 10, depiction of the extension spring 19 and the piece members 20 is omitted in this figure. The multi-joint bending structure 51 in the C-like form maintains the C-like form due to the action of the assisting force generation mechanism 5 as described above.

When the multi-joint bending structure 51 in the C-like form is returned to the multi-joint bending structure 51 in the I-like form, the external force is applied from inside to the bending unit 4 of the multi-joint bending structure 51 illustrated in FIG. 7E to return the multi-joint bending structure 51 to the state illustrated in FIG. 7C. If slight external force is further applied after the multi-joint bending structure 51 is returned to the state illustrated in FIG. 7C, the piece member 20 of the assisting force generation mechanism 5 moves and is latched to end of the bending rod-like body 10 adjacent to the bending rod-like body 10 to which the piece member 20 has been latched till now. Then, the direction in which the two piece members 20 of the assisting force generation mechanism 5 energize the bending rod-like bodies 10 matches the travelling direction of the belts 6L, 6R to which the bending rod-like bodies 10 are fixed, and the belts 6L, 6R move due to the energizing force of the piece members 20 even if no external force is applied.

As a result, the multi-joint bending structure 51 quickly changes from the bent state illustrated in FIG. 7C to the I-like form and afterward the I-like form is maintained. As such, when the multi-joint bending structure 51 is changed from the I-like form to the C-like form, or when the multi-joint bending structure 51 is returned from the C-like form to the I-like form, the external force may be applied partly, and then, due to the action of the assisting force generation mechanism 5, a desired form may be automatically obtained.

Figure 9A:
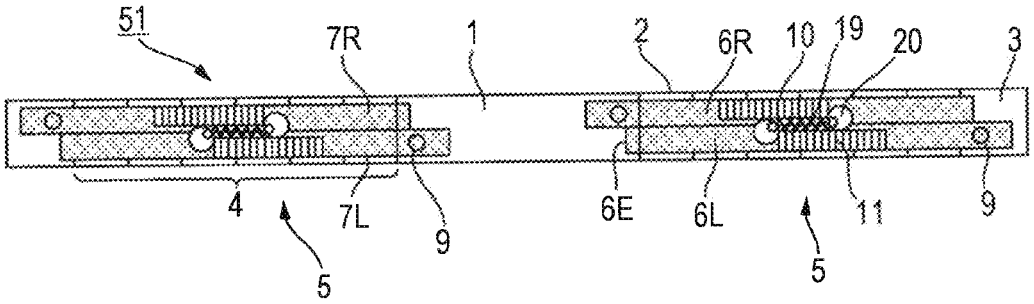
FIG. 9A is a plan view illustrating a state of the assisting force generation mechanism when the mufti-joint bending structure of the first example of the first mode of the present application is in the I-like form.
Figure 9B:
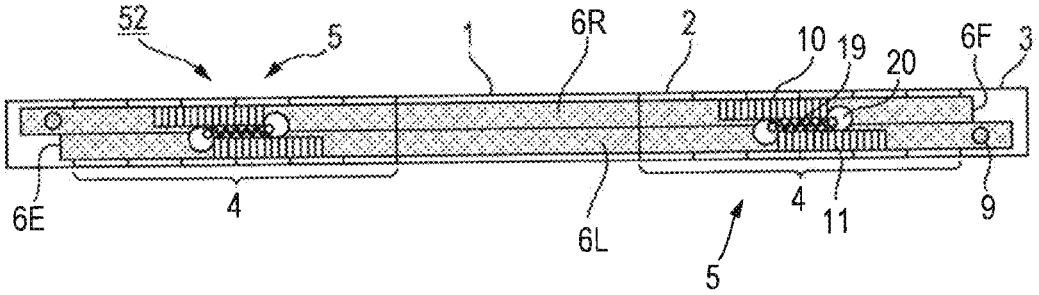
FIG. 9B is a plan view illustrating a state of the assisting force generation mechanism when a multi-joint bending structure of a second example of the first mode of the present application is in the I-like form.

FIG. 9A illustrates a state of an assisting force generation mechanism 5 when a multi-joint bending structure 51 of the first example of the first mode of the present application as described above is in an I-like form. For the multi-joint bending structure 51 of the first example of the first mode, a pair of belts 6L, 6R and a pair of belts 7L, 7R are respectively placed in housings of the second and third band pieces 2, 3 located to the right and left of the first band piece 1, and are provided with the assisting force generation mechanisms 5. In contrast to this, a multi-joint bending structure 52 of a second example of the first mode of the present application illustrated in FIG. 9B is possible in which the number of belts is reduced by integration of the belt 6L with the belt 7L and of the belt 6R with the belt 7R.

In the multi-joint bending structure 52, only a pair of belts 6L, 6R is provided in housings of the first to third band pieces 1 to 3. The belts 6L, 6R pass through the first band piece 1 and are arranged within the second and third band pieces 2, 3 which are located at both sides of the first band piece 1. Then, one end of the belt 6L is fixed by the screw 9 in the third band piece 3 located on one side of the first band piece 1. Similarly, one end of the belt 6R is fixed by a screw 9 in the third band piece 3 on the other side of the first band piece 1. Free ends 6E, 6F of the belts 6L, 6R are respectively in the third band pieces 3.

The assisting force generation mechanisms 5 in the multi-joint bending structure 52 are the same as the assisting force generation mechanisms 5 in the multi-joint bending structure 51 and are provided respectively in bending units 4 located to the right and left of the first band piece 1. In the multi-joint bending structure 52, a position of the bending unit 4 in the assisting force generation mechanism 5 is the same as a position of the bending unit 4 of the assisting force generation mechanism 5 in the multi-joint bending structure 51. Therefore, operation of the assisting force generation mechanism 5 when the multi-joint bending structure 52 is changed between the Hike form and the C-like form is exactly the same as the operation of the assisting force generation mechanism 5 when the multi-joint bending structure 51 described above is changed between the I-like form and the C-like form. Thus, a description of the operation of the assisting force generation mechanism 5 when the multi-joint bending structure 52 is changed between the I-like form and the C-like form is omitted.

Figure 9C:
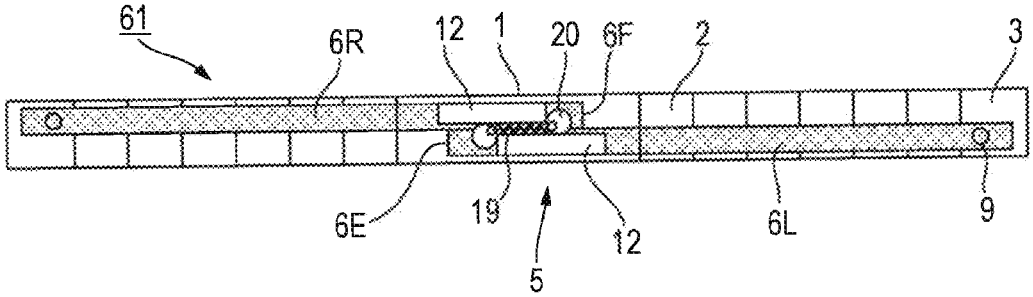
FIG. 9C is a plan view illustrating the assisting force generation mechanism when the multi-joint bending structure of a first example of a second mode of the present application is in the I-like form.

FIG. 9C illustrates a position and a state of the assisting force generation mechanism 5 when a multi-joint bending structure 61 of a first example of a second mode of the present application is in an I-like form. In the multi-joint bending structures 51, 52 of the first and second examples of the first mode, the assisting force generation mechanism 5 is provided within the bending unit 4. Thus, in the assisting force generation mechanism 5 are provided bending rod-like bodies 10 that are equipped with slits 11 and may change shape in response to bending of the belts 6L, 6R and the belts 7L, 7R.

On the one hand, in the second mode, as in the multi-joint bending structure 61 of the first example illustrated in FIG. 9C, the assisting force generation mechanism 5 is provided within the first band piece 1, which differs from the first mode. A connection structure by joint potions 55 of the first to third band pieces 1 to 3 in the second mode is the same as a connection structure of the first mode. Also, the second mode does not have to have a space where the assisting force generation mechanism 5 is housed in the bending unit 4. Furthermore, in the second mode, since the first band piece 1 does not bend, a non-bending rod-like body 12 is provided in place of the bending rod-like body 10 of the first mode. Note that the bending rod-like body 10 of the first mode may be used in the second mode.

A pair of belts 6L, 6R is provided in the multi-joint bending structure 61. The belt 6L is fixed by a screw 9 in the third band piece 3 whose one end is on one side of the first band piece 1. Similarly, the belt 6R is fixed by a screw 9 in the third band piece 3 whose one end is on the other side of the first band piece 1. Free ends 6E, 6F of the belts 6L, 6R are respectively located in the first band piece 1. In the neighborhood of the free ends 6E, 6F of the belts 6L, 6R, the rod-like bodies 12 are fixed in an opposed state, being spaced apart by predetermined gaps.

Then, when the multi-joint bending structure 61 is in the I-like form, two rod-like bodies 12 are fixed on the belts 6L, 6R so that overlapping portions and non-overlapping portions exist on the two rod-like bodies 12. The second mode is similar to the first mode in that an extension spring 19 is inserted between the gap of the two rod-like bodies 12, and piece members 20 connected to both ends of the extension spring 19 are latched to ends of the rod-like bodies 12 located on both sides of the overlapping portion of the rod-like body 12, thereby forming the assisting force generation mechanism 5.

Figure 10A:
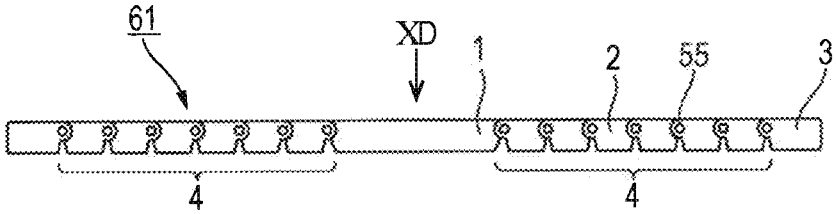
FIG. 10A is a side elevation when the multi-joint bending structure of the first example of the second mode illustrated in FIG. 9C is in the I-like form.
Figure 10B:
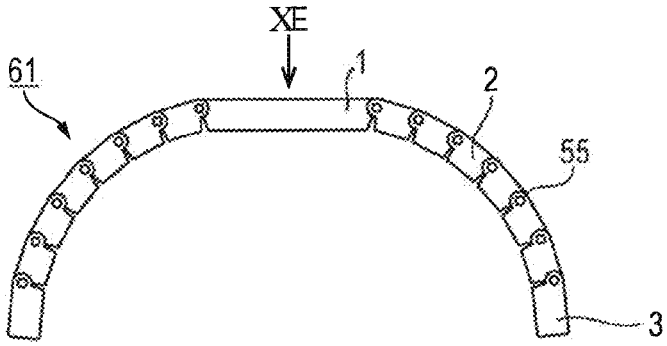
FIG. 10B is a side elevation illustrating a side elevation illustrating a state while the multi-joint bending structure illustrated in FIG. 10A changes in position from the I-like form to the C-like form.

FIG. 10A is a view from the lateral face of the state in which the multi-joint bending structure 61 of the first example of the second mode illustrated in FIG. 9C is in the I-like form. In addition, FIG. 10B is a view from the lateral face of a state in which the multi-joint bending structure 61 illustrated in FIG. 10A is changing in position from the I-like form to the C-like form. Furthermore, FIG. 10C is a view from the lateral face of a state in which the multi-joint bending structure 61 illustrated in FIG. 10B changes in position to the C-like form.

Figure 10C:
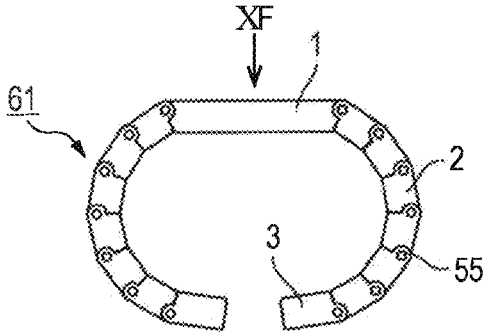
FIG. 10C is a side elevation illustrating a state when the multi-joint bending structure illustrated in FIG. 10B changes in position to the C-like form.
Figure 10D:
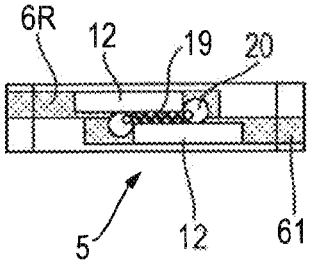
FIG. 10D is an arrow view, when viewed from a direction of an arrow XD, of a state of the assisting force generation mechanism which is in the multi-joint bending structure illustrated in FIG. 10A.
Figure 10E:
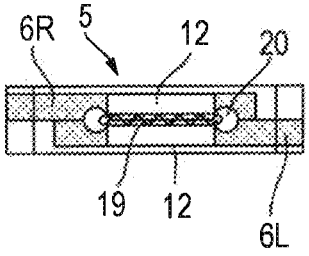
FIG. 10E is an arrow view, when viewed from a direction of an arrow VIIB, of a state of the assisting force generation mechanism which is in the multi-joint bending structure illustrated in FIG. 10B, and FIG. 1OF is an arrow view when viewed from a direction of an arrow XF, of a state of the assisting force generation mechanism which is in the multi-joint bending structure illustrated in FIG. 10C.

Then, FIG. 10D is a view from a direction of an arrow XD of a state of the assisting force generation mechanism 5 which is within the first band piece 1 of the multi-joint bending structure 61 illustrated in FIG. 10A. In addition, FIG. 10E is a view from a direction of an arrow XE of a state of the assisting force generation mechanism 5 which is within the first band 1 of the multi-joint bending structure 61 illustrated in FIG. 10B. Furthermore, FIG. 1OF is a view from a direction of an arrow XF of a state of the assisting force generation mechanism 5 which is within the first band 1 of the multi-joint bending structure 61 illustrated in FIG. 10C.

Figure 10F:
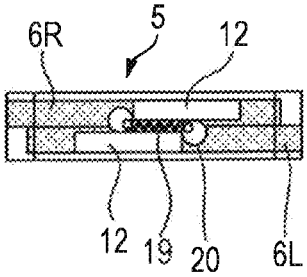

When the multi-joint bending structure 61 changes in position from the I-like form illustrated in FIG. 10A to the C-like form illustrated in FIG. 10C by going through the bent form illustrated FIG. 10B, the assisting force generation mechanism 5 operates as illustrated in FIG. 10D to FIG. 10F. If the bending rod-like body 10 is replaced by the rod-like body 12, this operation is the same as the operation of the assisting force generation mechanism 5 in the multi-joint bending structure 51 of the first example of the first mode described above. Thus, same members are assigned same numerals and a description of this operation is omitted.

Figure 11A:
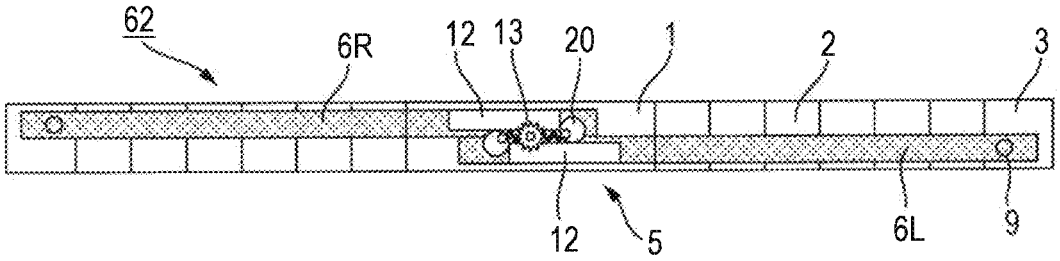
FIG. 11A is a plan view illustrating a state of the assisting force generation mechanism when a multi-joint bending structure of a second example of the second mode of the present application is in the I-like form.

FIG. 11A illustrates a state of an assisting force generation mechanism 5 when a multi-joint bending structure 62 of a second example of the second mode of the present application is in an I-like form. In the multi-joint bending structure 61 of the first example of the second mode described in FIG. 9C and FIG. 10A to FIG. 10F, the belts 6L, 6R may respectively move independently. FIG. 10A to FIG. 10F describe that the bending units 4 on both sides of the first band piece 1 similarly bend and how the multi-joint bending structure 61 in the I-like form as illustrated in FIG. 10A changes in position to the multi-joint bending structure 61 in the C-like form as illustrated in FIG. 10C. However, in the multi-joint bending structure 61 of the first example of the second mode, it is possible to bend only the bending unit 4 on the one side of the first band piece 1 and form the multi-joint bending structure 61 in a J-like form.

On the one hand, in the multi-joint bending structure 62 of the second example of the second mode, provision of a pinion 13 in the assisting force generation mechanism 5 does not allow respective belts to move independently. Specifically, in the multi-joint bending structure 62, the belts 6L, 6R are connected by the pinion 13. Thus, when the belt 6L moves, the belt 6R moves in an opposite direction to the belt 6L by an equal distance as the belt 6L. This is a difference between the multi-joint bending structure 61 of the first example of the second mode and the multi-joint bending structure 62 of the second example.

Figure 11B:
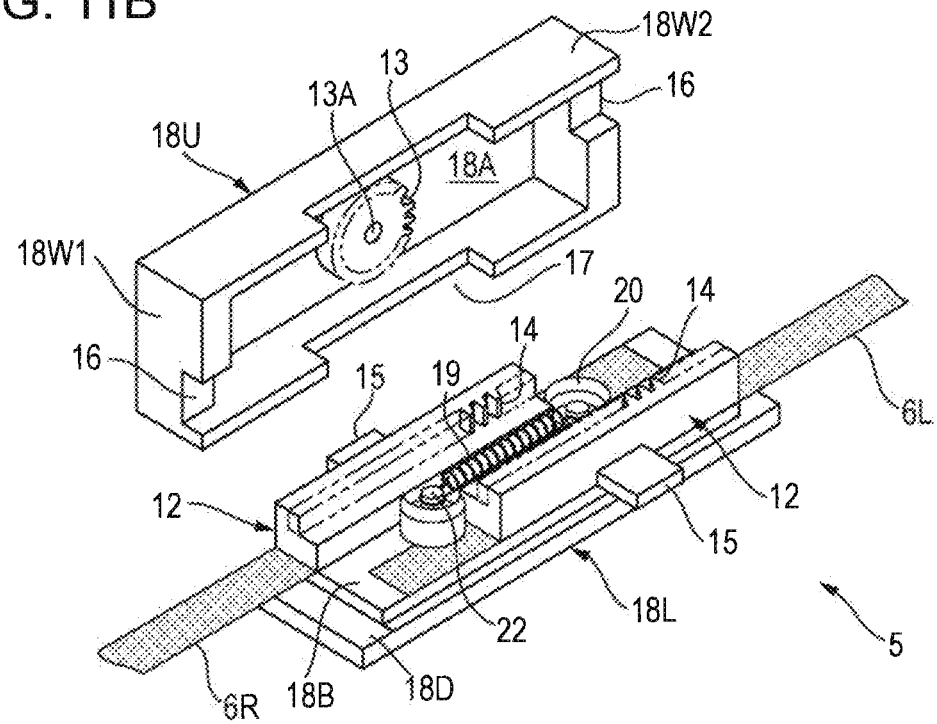
FIG. 11B is an assembly perspective view of a specific structure example of the assisting force generation mechanism illustrated in FIG. 11A.
Figure 11C:
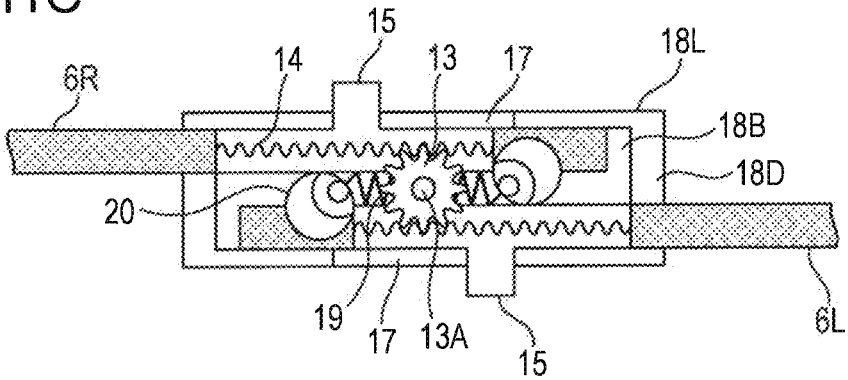
FIG. 11C is a plan view of a state in which an upper-side cover of the assisting force generation mechanism illustrated in FIG. 11B is removed.

FIG. 11B illustrates a specific structure example of the assisting force generation mechanism 5 illustrated in FIG. 11A and the assisting force generation mechanism 5 is provided in the first band piece 1. The first band piece 1 includes an upper case 18U and a lower case 18L. Note that in this specific structure example, depiction of a joint potion between the first band piece 1 and the second band piece 2 is omitted. FIG. 11C illustrates a state in which the upper-side cover of the assisting force generation mechanism 5 illustrated in FIG. 11B is removed with the pinion 13 remaining intact. The upper case 18U is shaped like a bathtub and the pinion 13 is rotatably fixed to a rotating shaft 13A which is installed at a central part of a concave 18A in a protruding manner. In addition, on a wall part 18W1 in short direction of the upper case 18U is formed a belt notch 16 for causing the belts 6L, 6R to pass. On a wall part 18W2 in a longitudinal direction is formed a lever notch 17 for causing a lever 15 to be described below to move.

In the lower case 18L, a step part 18D to which the wall parts 18W1, 18W2 of the upper case 18U are mounted is formed in a peripheral area, and there is bottom face 18B surrounded by the step part 18D. The belts 6L, 6R slide over the bottom face 18B. Racks 14 are provided on upper surfaces of the rod-like bodies 12 which are fixed onto the belts 6L, 6R. Gear wheels provided in the racks 14 are opposed and a distance between the racks 14 is equal to a diameter of the pinion 13 installed on the upper cover 18U. In addition, the lever 15 is installed in a protruding manner on the lateral face of the rod-like body 12 in the longitudinal direction. The points that the extension spring 19 is inserted in a gap between the two rod-like bodies 12 and the piece members 20 connected to both ends of the extension spring 19 are latched to the end faces of the overlapping portions of the rod-like bodies 12 is the same as hereinbefore. When the upper case 18U is installed on the lower case 18L, the pinion 13 engages with the rack 14 and the lever 15 protrudes outward from the lever notch 17, as illustrated in FIG. 11C.

Figure 12A:
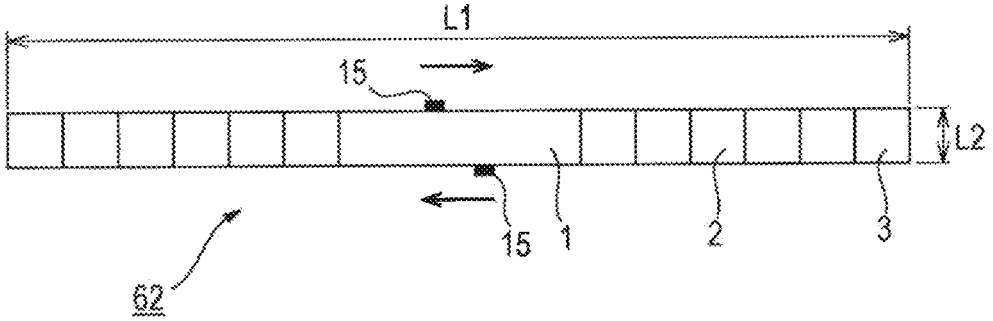
FIG. 12A is a plan view when the assisting force generation mechanism of the specific structure example illustrated in FIG. 11B.
Figure 12B:
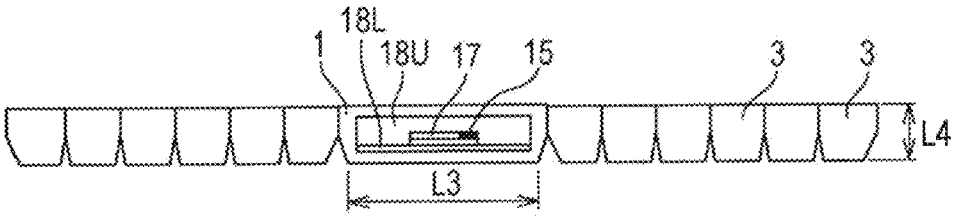
FIG. 12B is a side elevation of the multi-joint bending structure illustrated in FIG. 12A.
Figure 12C:
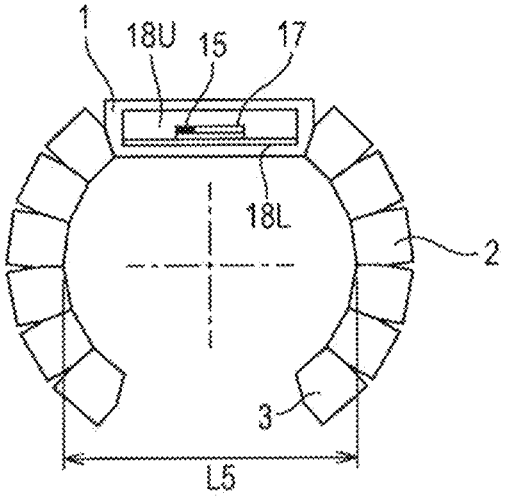
FIG. 12C is a side elevation when the multi-joint bending structure illustrated in FIG. 12B is in the C-like form.

FIG. 12A is a planar view of a state of the multi-joint bending structure 62 in the I-like form including the first band piece in which the assisting force generation mechanism 5 of the specific example illustrated in FIG. 11B, FIG. 11C is embedded. The lever 15 protrudes from the lateral faces on both sides of the band piece 1. Total length Li of the multi-joint bending structure 62 may be approximately 60 mm and width L2 approximately 10 mm. FIG. 12B illustrates a state viewed from the lateral face of the multi-joint bending structure 62 illustrated in FIG. 12A. Length L3 of the first band piece 1 may be approximately 35 mm and height L4 approximately 10 mm. FIG. 12C is a view from the lateral face in which the multi-joint bending structure 62 is in the C-like form. When the multi-joint bending structure 62 has dimensions described above, an inner diameter L5 of the multi-joint bending structure 62, when in the C-like form, is approximately 55 mm, which enables the multi-joint bending structure 62 to be attached to a wrist and the like.

In addition, if the lever 15 is fixed to the rod-like body 12 in a protruding manner and the lever 15 protrudes outside of the upper case 18U with the upper case 18U attached to the lower case 18L of the first piece band 1, it is possible to change shape of the multi-joint bending structure 62 by sliding the lever 15. Specifically, in the state illustrated in FIG. 12A, by moving the lever 15 to a direction depicted by an arrow, it is possible to change shape of the multi-joint bending structure 62 from the I-like form to the C-like form illustrated in FIG. 12C. Operation of the assisting force generation mechanism 5 in the multi-joint bending structure 62 is similar to the operation of the assisting force generation mechanism 5 in the multi-joint bending structure 61.

Figure 13A:
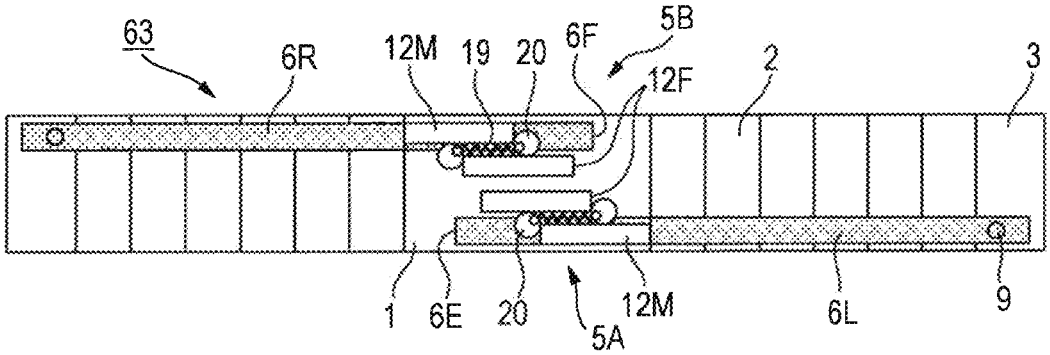
FIG. 13A is a plan view illustrating a state of the assisting force generation mechanism when a multi-joint bending structure of a third example of the second mode of the present application is in the I-like form.

FIG. 13A is a planar view of a state of an assisting force generation mechanism 5 when a multi-joint bending structure 63 of a third example of the second mode of the present application is in an I-like form. The multi-joint bending structure 63 of the third example of the second mode has a modified structure of the assisting force generation mechanism 5 of the multi-joint bending structure 61 of the first example of the second mode. While one assisting force generation mechanism 5 is provided within the first band piece 1 of the multi-joint bending structure 61, a first assisting force generation mechanism 5A and a second assisting force generation mechanism 5B are provided within the first band piece 1 in the multi-joint bending structure 63.

The first assisting force generation mechanism 5A includes a moving rod-like body 12M provided on the side of a free end 6E of a belt 6L and a fixed rod-like body 12F provided on a housing of the first band piece 1. Then, two piece members 20 connected by an extension spring 19 are bridged between ends of overlapping portions of the moving rod-like body 12M and the fixed rod-like body 12F.

Similarly, the second assisting force generation mechanism 5B includes a moving rod-like body 12M provided on the side of a free end 6F of a belt 6R and a fixed rod-like body 12F provided on a housing of the first band piece 1. Then, two piece members 20 connected by the extension spring 19 are bridged between the ends of the moving rod-like body 12M and the fixed rod-like body 12F. Width of the moving rod-like body 12M and of the fixed rod-like body 12F is equal to width of the rod-like body 12 of the assisting force generation mechanism 5. Thus, the same belts as the belts 6L, 6R used in the multi-joint bending structure 61 may be used for the belts 6L, 6R.

Figure 13B:
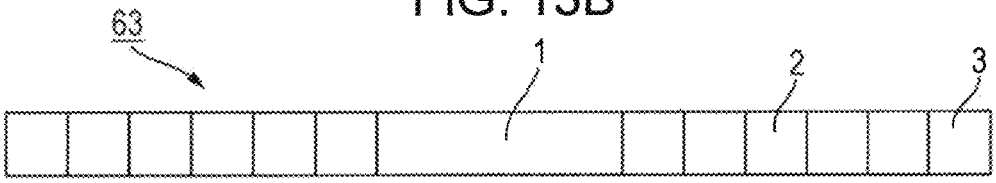
FIG. 13B is a plan view when the multi-joint bending structure of the third example of the second embodiment of the present application is in the I-like form.
Figure 13C:
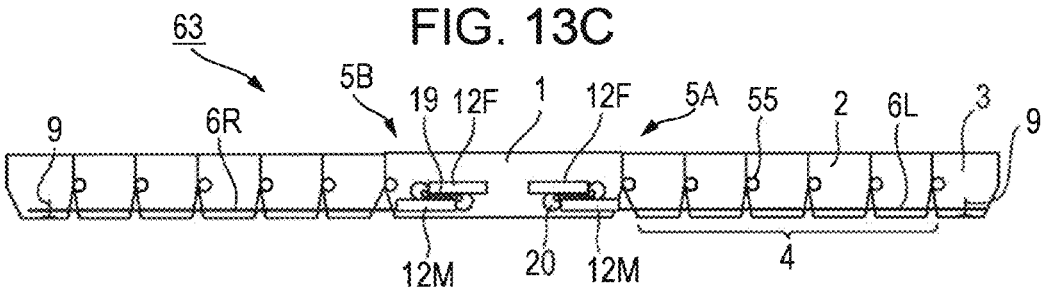
FIG. 13C is a side elevation illustrating a state of the assisting force generation mechanism embedded in the multi-joint bending structure illustrated in FIG. 13B.
Figure 13D:
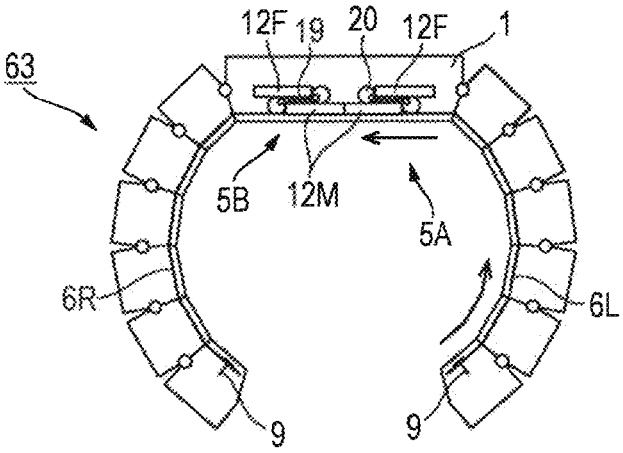
FIG. 13D is a side elevation illustrating a state of the assisting force generation mechanism embedded in the multi-joint bending structure when the multi-joint bending structure illustrated in FIG. 13C is in the C-like form.

FIG. 13B is a planar view of a state in which the multi-joint bending structure 63 of the third example of the second mode of the present application is in the I-like form. FIG. 13C illustrates a state of the first and second assisting force generation mechanism 5A, 5B embedded in the multi-joint bending structure 63 illustrated in FIG. 13B. The operation of the first and second assisting force generation mechanism 5A, 5B when the multi-joint bending structure 63 changes shape between the Hike form and the C-like form is similar to the operation of the rod-like body 12 in the assisting force generation mechanism 5 as described hereinbefore. Therefore, in the state illustrated in FIG. 13C, if external force is applied to a bending unit 4 from outside of an joint potion 55, the multi-joint bending structure 63 easily changes shape to the C-like form illustrated in FIG. 13D due to the operation of the first and second assisting force generation mechanisms 5A, 5B. This also applies when the multi-joint bending structure 63 is returned from the C-like form to the I-like form.

Figure 14A:
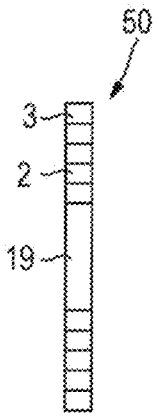
FIG. 14A is a plan view of a multi-joint bending structure of the present application which is shaped like an elongate wrist band.
Figure 14B:
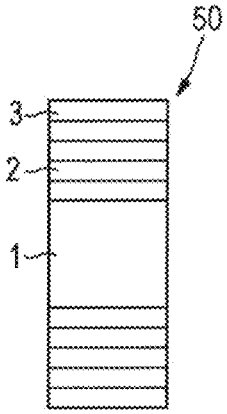
FIG. 14B is a plan view of a multi-joint bending structure of the present application which is shaped like a wide, straight terminal.
Figure 14C:
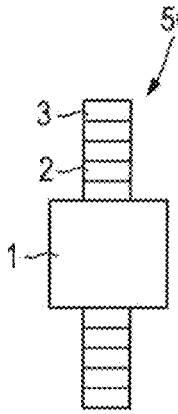
FIG. 14C is a plan view of a multi-joint bending structure of the present application which is shaped like a watch.

Here, a usage example of the multi-joint bending structure 50 is described through the use of the multi-joint bending structure 50 which represents the multi-joint bending structures 51, 52, 61, 62, 63 of the examples described above. FIG. 14A is a view illustrating the multi-joint bending structure 50 having an elongate wrist-band shape. An electronic device such as a pedometer may be embedded in the housing of the multi-joint bending structure 50. FIG. 14B illustrates the multi-joint bending structure 50 having a wide band shape. A terminal may be embedded as an electronic device in the housing of the multi-joint bending structure 50 in this example. FIG. 14C illustrates the multi-joint bending structure 50 having a watch shape. Since only a first band piece 1 of the multi-joint bending structure 50 in this example is wide, the terminal may be embedded in or overlappingly attached to the first band piece 1.

Figure 14D:
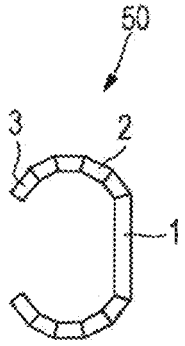
FIG. 14D is a side elevation when the multi-joint bending structures illustrated in FIG. 14A to FIG. 14C are in the C-like form.
Figure 14E:
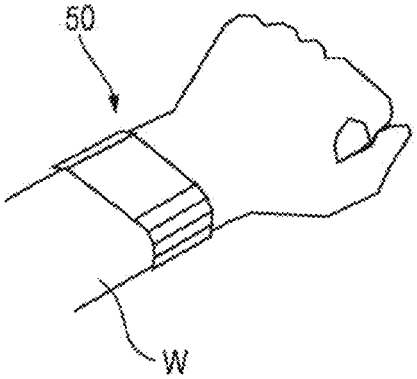
FIG. 14E is a perspective view illustrating a usage state in the C-like form of the multi-joint bending structure illustrated in FIG. 14B.
Figure 14F:
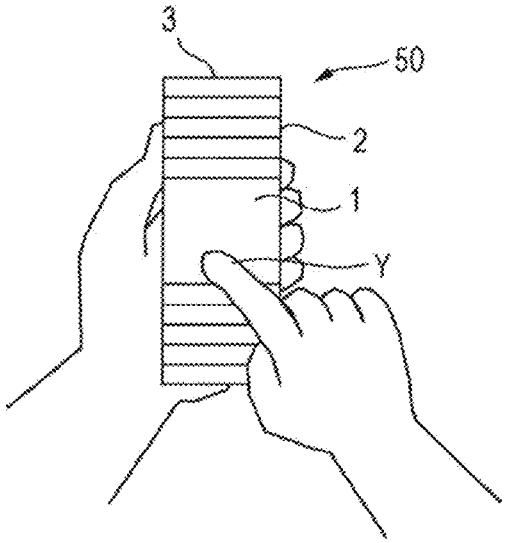
FIG. 14F is a perspective view illustrating a usage state in the I-like form of the multi-joint bending structure illustrated in FIG. 14B.

The multi-joint bending structure 50 illustrated in FIG. 14A to FIG. 14C may be caused to change the shape to the C-like form illustrated in FIG. 14D to be used by being put on the arm W as illustrated in FIG. 14E. In addition, since the multi-joint bending structure 50 illustrated in FIG. 14B is wide, the multi-joint bending structure 50 may be used as a terminal in a straight shape illustrated in FIG. 14F. As such, the multi-joint bending structure 50 in which the assisting force generation mechanism 5 is embedded in and an electronic device is embedded or attached may be used as an electronic device even in a bent state or in a stretched state.

Figure 15A:
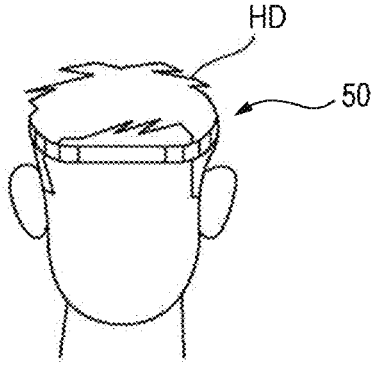
FIG. 15A is an explanatory diagram illustrating an example in which the multi-joint bending structure illustrated in FIG. 14A is used as a head band.
Figure 15B:
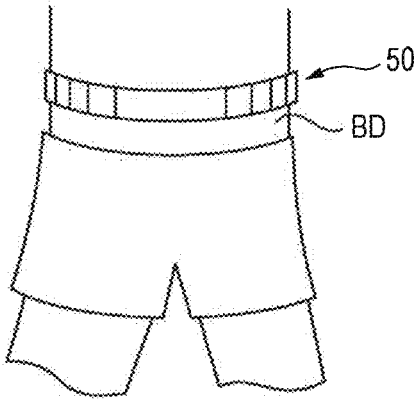
FIG. 15B is an explanatory diagram illustrating an example in which the multi-joint bending structure illustrated in FIG. 14A is attached to the waist and used.
Figure 15C:
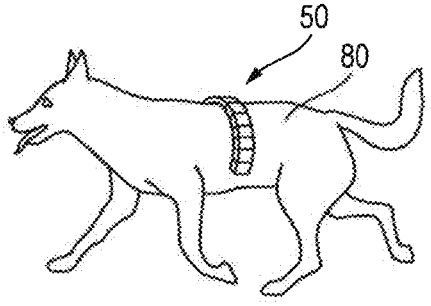
FIG. 15C is an explanatory diagram illustrating an example in which the multi-joint bending structure illustrated in FIG. 14A is attached to an animal and used.

Furthermore, by making length when the first to third band pieces 1 to 3 are connected longer, the multi-joint bending structure 50 may be attached to the head HD as a head band as illustrated in FIG. 15A or may be used by being attached to the waist BD as illustrated in FIG. 15B. Furthermore, the multi-joint bending structure 50 may be attached not only to the human body but also to an animal 80 as illustrated in FIG. 15C. When the multi-joint bending structure 50 is used being attached to the animal 80, and if a GPS device is embedded in any of the first to third band pieces 1 to 3, it is convenient to look for the animal 80.

Figure 15D:
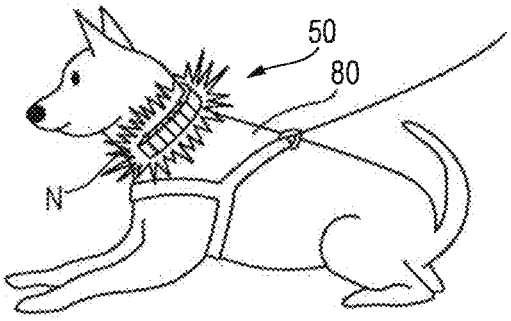
FIG. 15D is an explanatory diagram illustrating an example in which the multi-joint bending structure illustrated in FIG. 14A having an embedded shining illumination device is used as a collar for a dog.
Figure 15E:
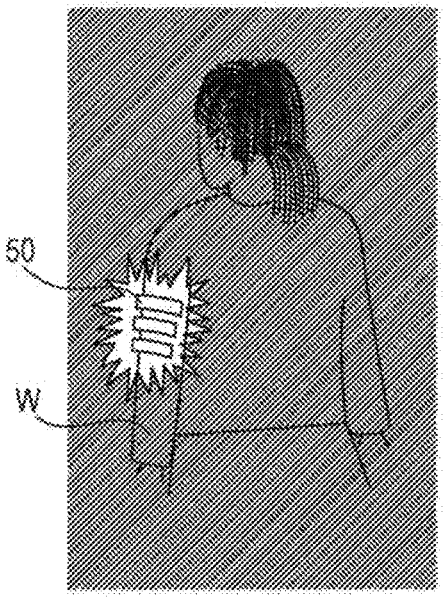
FIG. 15E is an explanatory diagram illustrating an example in which the multi-joint bending structure illustrated in FIG. 14A having an embedded shining illumination device is attached to a human arm and used as a crime-prevention tool.

In addition, since the multi-joint bending structure 50 of the present application may be easily attached or detached, the multi-joint bending structure 50 is useful in walking a dog on the road at night if an illumination device which shines or blinks is embedded as an electronic device and is attached to the neck of the animal 80 as illustrated in FIG. 15D. In addition, as illustrated in FIG. 15E, if an illumination device is embedded in the wrist-band shaped multi-joint bending structure 50 which is then attached to the arm W, the multi-joint bending structure 50—is useful for an anticrime measure for women or children at night. In addition, the multi-joint bending structure 50 of the present application in which the assisting force generation mechanism 5 is embedded may be easily attached or detached even if the multi-joint bending structure is attached to one arm and only the other arm may be used.

Note that while in the examples described above, the bending rod-like body or the rod-like body of the assisting force generation mechanism is fixed to the belt, the bending rod-like body or the rod-like body may be fixed to a linear body other than a belt, such as a wire. In addition, there is no special limitation to the number of the second band pieces forming the bending unit of the assisting force generation mechanism or dimensions of the assisting force generation mechanism.

So far the present application has been described in detail with reference to preferred embodiments, in particular. For easy understanding of the present application, specific modes of the present application are described below.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A multi-joint bending structure comprising:

a first band piece including joint potions on both ends;

bending units arranged on both sides of the first band piece and each including a plurality of second band pieces each including joint potions provided on both ends and connected with joint potions of other pieces, the bending units enabling the multi-joint bending structure to change in position between a straight state and a bent state;

a third band piece including a joint potion provided on one end, the joint portion connected to the joint potion of the end of one of the bending units;

at least one pair of two linear bodies provided on a side of housings of the first to third band pieces, the side becoming an inner peripheral side of the joint potions in the bent state, each of the linear bodies having one end fixed to the housings and another end movable along the housings when the multi-joint bending structure changes in position; and an assisting force generation mechanism provided at predetermined opposed positions of the pair of two linear bodies and configured to generate assisting force when the multi-joint bending structure changes in position between the straight state and the bent state, wherein the assisting force generation mechanism comprises rod-like bodies which have an equal length, are fixed respectively onto the pair of two linear bodies, and have non-overlapping portions and overlapping portions that overlap each other across a predetermined gap, a contracting elastic body inserted into the gap, and two piece members which each have an outer shape larger than the gap, and which are connected to both ends of the elastic body and energize both ends of the overlapping portions of the rod-like bodies by contracting force of the elastic body, and after the elastic body is extended to the maximum in the course of movement of the pair of two linear bodies in opposite directions while the multi-joint bending structure changes in position between the straight state and the bent state, both the ends of the overlapping potions energized by the piece members switch over, and the contracting force of the elastic body acts as the assisting force between both the ends.

2. The multi-joint bending structure according to claim 1, wherein two pairs of the linear bodies are provided, the two linear bodies of each pair are arranged in the corresponding one of spaces between the first band piece and the third band pieces which are positioned on both sides of the first band piece, an end of one of the two linear bodies is fixed within the first and piece and an end of the other one of the two linear bodies is fixed in one of the third band pieces, and the rod-like bodies of each pair are positioned in the corresponding one of the bending units and are bendable in an inner periphery direction.

3. The multi-joint bending structure according to claim 1, wherein one pair of the linear bodies are provided, the two linear bodies pass through the first band piece and are arranged in the second and third band pieces positioned at both sides of the first band piece, an end of one of the two linear bodies is fixed in one of the third band pieces and an end of the other one of the two linear bodies is fixed in the other third band piece, and the rod-like bodies are provided at two positions on each of the two linear bodies in the second band pieces positioned on both ends of the first band piece, the rod-like bodies being bendable in the inner periphery direction.

4. The multi-joint bending structure according to claim 1, wherein the linear bodies are belts bendable in a bending direction of the multi-joint bending structure, each of the rod-like bodies is provided with a plurality of slits extending in a direction perpendicular to a longitudinal direction of the rod-like bodies from a face of the rod-like body opposite to a face fixed to the liner body, and the slits expand when the bending unit is bent.

5. The multi-joint bending structure according to claim 1, wherein one pair of the linear bodies are provided, the fixed ends of the two linear bodies are respectively within the third band pieces on both sides of the first band piece, while the free ends of the two linear bodies are within the first band piece, one assisting force generation mechanism is provided for the pair of linear bodies, and the rod-like body is provided within the first band piece.

6. The multi-joint bending structure according to claim 5, wherein the two rod-like bodies are provided with racks at portions where the racks do not interfere with opposing faces of the gap in which elastic body is housed, a pinion attached to a rotating shaft provided in the first band piece meshes with the racks, and the two rod-like bodies move equidistantly to the right and left with respect to the rotating shaft by the racks and the pinion.

7. The multi-joint bending structure according to claim 1, wherein one pair of the linear bodies are provided, the fixed ends of the two linear bodies are respectively within the third band pieces on both sides of the first band piece and the free ends of the two linear bodies are within the first and piece, the assisting force generation mechanism is provided being divided to a first assisting force generation mechanism and a second assisting force generation mechanism which respectively apply assisting force to the pair of linear bodies, the first assisting force generation mechanism comprises a moving rod-like body provided on the free end of one of the linear bodies of the pair, a fixed rod-like body provided on the housing of the first banc piece, and two piece members connected to each other by the elastic body routed between ends of overlapping portions of the moving rod-like body and the fixed rod-like body, and the second assisting force generation mechanism comprises a moving rod-like body provided on the free end of the other linear body of the pair, a fixed rod-like body provided on the housing of the first banc piece, and two piece members connected to each other by the elastic body routed between ends of overlapping portions of the moving rod-like body and the fixed rod-like body.

8. The multi-joint bending structure according to claim 5, wherein one of the moving rod-like bodies is provided with a lever protruding outside of the first band piece, and a tip of the lever protrudes outside of the first band piece.

9. The multi-joint bending structure according to claim 1, wherein the first band piece, the bending units, and the third band piece are formed to be dividable along the longitudinal direction thereof into right and left sides, and the pair of linear bodies and the assisting force generation mechanism are attached to inside of the first band piece, the bending units, and the third band piece in a divided state.

10. The multi-joint bending structure according to claim 1, wherein the elastic body is a coil spring.

11. A wearable device using the multi-joint bending structure according to claim 1, wherein an electronic device is mounted on an inside or an outer periphery of at least one of the first band piece, the bending units, and the third band piece.

12. The wearable device using the multi-joint bending structure according to claim 11, wherein the electronic device comprises an electronic circuit arranged within the housing of the first band piece, and a display unit arranged on the outer periphery.

13. The wearable device using the multi-joint bending structure according to claim 11, wherein the electronic device is attached to the outer periphery of the housing of the first band piece, and includes an electronic circuit and a display unit inside the electronic device.

14. The wearable device using the multi-joint bending structure according to claim 11, wherein the electronic device is a light emitting device which causes at least of the first band piece, the bending unit, and the third band piece to emit light.

15. The wearable device using the multi-joint bending structure according to claim 11, wherein width of the first band piece in which the electronic device is mounted is equal to widths of the second band piece and the third band piece.

16. The wearable device using the multi-joint bending structure according to claim 11, wherein width of the first band piece on which the electronic device is mounted is larger than widths of the second band piece and the third band piece.

17. The wearable device using the multi-joint bending structure according to claim 11, wherein an inside diameter of the bending unit in the bent state is almost equal to an outside diameter of a human arm.

18. The wearable device using the multi-joint bending structure according to claim 11, wherein an inside diameter of the bending unit in the bent state is almost equal to a human waistline dimension.

19. The wearable device using the multi-joint bending structure according to claim 11, wherein an inside diameter of the bending unit in the bent state is almost equal to a human head dimension.

20. The wearable device using the multi-joint bending structure according to claim 11, wherein the electronic device is a communication terminal.

* * * * *